United States Patent [19]

Tamoto et al.

[11] Patent Number: 4,857,447

[45] Date of Patent: Aug. 15, 1989

[54] SILVER HALIDE COLOR PHOTOGRAPHIC LIGHT-SENSITIVE MATERIAL CONTAINING A COUPLER HAVING A DYE MOIETY

[75] Inventors: Koji Tamoto; Mitsunori Ono, both of Kanagawa, Japan

[73] Assignee: Fuji Photo Film Co., Ltd., Kanagawa, Japan

[21] Appl. No.: 867,718

[22] Filed: May 28, 1986

[30] Foreign Application Priority Data

May 28, 1985 [JP] Japan ..... 60-114732

[51] Int. Cl.[4] ..... G03C 1/08; G03C 7/26; G03C 7/32

[52] U.S. Cl. ..... 430/544; 430/226; 430/562; 430/958

[58] Field of Search ..... 430/226, 544, 958, 562

[56] References Cited

U.S. PATENT DOCUMENTS

| | | | |
|---|---|---|---|
| 3,725,062 | 4/1973 | Anderson et al. | 430/562 |
| 4,193,795 | 3/1980 | Campbell et al. | 430/958 X |
| 4,248,962 | 2/1981 | Lau | 530/548 X |
| 4,409,323 | 10/1983 | Sato et al. | 430/558 X |
| 4,421,845 | 12/1983 | Uemura et al. | 430/558 X |
| 4,493,885 | 1/1985 | Fujita et al. | 430/226 X |
| 4,504,568 | 3/1985 | Clark et al. | 430/226 X |
| 4,605,613 | 8/1986 | Van de Sande et al. | 430/562 |

FOREIGN PATENT DOCUMENTS 2615402 10/1976 Fed. Rep. of Germany .

*Primary Examiner*—Mukund J. Shah

*Attorney, Agent, or Firm*—Sughrue, Mion, Zinn, Macpeak & Seas

[57] ABSTRACT

A silver halide color photographic light-sensitive material is disclosed, comprising (1) a coupler having a dye moiety, the maximum absorption wavelength of which is shifted to the shorter wavelength by a bond cleaving, directly or through a timing group, due to a coupling reaction with an oxidized product of an aromatic primary amine-based developing agent, and, as a result of the reaction, forming a compound having a dye portion which has the original maximum absorption wavelength before shifting; and (2) a compound releasing a development inhibitor directly or through a timing group upon reacting with the oxidized aromatic primary amine-based developing agent.

16 Claims, No Drawings

SILVER HALIDE COLOR PHOTOGRAPHIC LIGHT-SENSITIVE MATERIAL CONTAINING A COUPLER HAVING A DYE MOIETY

BACKGROUND OF THE INVENTION

The present invention relates to a silver halide color photographic light-sensitive material. More particularly it is concerned with a silver halide color photograrphic light-sensitive material characterized by containing a coupler the dye moiety of which, said dye moiety having been shifted in its maximum absorption wavelength to the shorter wavelength side, forms a dye having the original maximum absorption wavelength of the dye moiety due to coupling reaction with an oxidized product of an aromatic primary amine developing agent, and a compound which releases a development inhibitor or its precursor upon reaction with an oxidized product of an aromatic primary amine developing agent.

In conventional silver halide color light-sensitive materials, the desired color images have been obtained by forming dyes such as indophenol, indoaniline, indamine, azomethine, phenoxazine, phenazine and the like through the reaction between an oxidized product of an aromatic primary amine color developing agent and a color image-forming agent (i.e., a coupler).

Color reproduction in the above system is usually carried out by the substractive process; i.e., silver halide emulsions selectively sensitive to blue, green and red, and yellow, magenta and cyan color image-forming agents (yellow, magenta and cyan coupler, respectively) in complementary relation with the above emulsions are used.

These couplers and dyes derived from the couplers govern photographic properties such as sensitivity, graininess, sharpness and color reproductivity of the color light-sensitive material, or storage stability of dye images formed to light and heat. Thus extensive investigations have been made on improvements of the couplers. The color image-forming method utilizing as image-forming dyes only dyes such as indophenol, indoaniline, indamine and azomethine dyes as formed due to a coupling reaction with an oxidized product of an aromatic primary amine-based color developing agent has already been developed to such a technical level that no significant further improvement could be expected.

Japanese Patent Application (OPI) Nos. 145135/79 and 56837/72 (the term "OPI" as used herein means a "published unexamined Japanese patent application") disclose novel photographic couplers releasing a photographically useful group (PUG) from a coupler radical through a timing group by the coupling reaction with an oxidized developing agent. It is described that PUG includes, as well as a development inhibitor, a developer, a bleach inhibitor and a coupler, a photographic dye. In the case that PUG is a photographic dye, however, the effects of the photographic dye on photographic performance or properties are not disclosed at all in Japanese Patent Application (OPI) No. 56837/72. On the other hand, Japanese Patent Application (OPI) No. 145135/79 discloses that when a photographic dye as the released PUG is used, the color density is increased as a function of the coupler. However, there is no disclosure about the effects on the photographic performance in the color image-forming method of color photographic materials. Moreover there cannot be found any description about photographic properties such as sharpness, graininess and color reproductivity when the photographic dye is used in the presence of other photographic materials in the photographic element.

One of the features of the present invention is to use a coupler which is characterized in that it contains a dye moiety the maximum absorption wavelength of which has been shifted to a shorter wavelength by a bond undergoing a cleavage upon the coupling reaction with the oxidized product of an aromatic primary amine developing agent, and it forms, as a result of the coupling reaction, a compound containing a dye moiety having the original maximum absorption wavelength thereof. In the photographic material of the present invention, when a dye is formed by bonding the coupler radical of the coupler of the present invention with the oxidized product of an aromatic primary amine developing agent another dye is formed by a bond cleavage thereby forming an image. This dye formed by cleavage of a bond from the nucleus of the coupler radical makes it possible to solve various problems as encountered in using only dyes formed by the coupling reaction of the conventional couplers with the oxidized product of a developing agent. That is, an increase in dye image density, i.e., color density, an improvement in color reproductivity by controlling the hue of color image, and an increase in fastness of the color image can be realized. As a result of the increase in color density, amounts of the coupler corresponding to the increase of color density and the silver halide used can be decreased, thereby the layer thickness can be decreased to improve the sharpness. However the graininess is still unsatisfactory even though the sharpness is increased by decreasing the layer thickness. In a low light exposure range where the graininess is recognized, the sharpness and the graininess are not satisfied at the same time.

SUMMARY OF THE INVENTION

The main object of the present invention is to provide a color photographic light-sensitive material which is excellent in both sharpness and graininess.

It has been found that the object is attained by using a coupler containing a dye moiety which is shifted in maximum absorption wavelength by a bond cleaving directly or through a timing group by the coupling reaction with an oxidized product of a developing agent and which, as a result of the coupling reaction, forms a compound containing a dye moiety which has the original maximum absorption wavelength before shifting or precursor of the compound; and a compound releasing a development inhibitor or its precursor through the reaction with an oxidized developing agent.

The present invention relates to a silver halide color photographic light-sensitive material comprising:

a coupler having a dye moiety which is shifted in the maximum absorption wavelength to the shorter wavelength side by a bond cleaving directly or through a timing group, due to a coupling reaction with an oxidized product of an aromatic primary amine-based, and, as a result of the coupling reaction, forming a compound containing a dye portion which has the original maximum absorption wavelength as before shifting to a shorter wavelength side or precursor of the dye.

a compound releasing a development inhibitor or a precursor thereof, directly or through a timing group, upon reacting with an oxidized product of an aromatic primary amine-based developing agent.

DETAILED DESCRIPTION OF THE INVENTION

The coupler containing a dye moiety which is shifted in maximum absorption wavelength to the shorter wavelength side by a bond cleaving directly or through a timing group, due to coupling reaction with an oxidized developing agent and, as a result of the coupling reaction, forming a compound which contains a dye moiety having the original maximum absorption wavelength before shifting or a precursor of the compound is preferably represented by formula (I)

$$Cp—(TIME)_n—X—Dye \quad (I)$$

wherein Cp is a coupler radical and the bond between Cp and $(TIME)_n$—X—Dye is capable to cleave upon the coupling reaction with an oxidized product of an aromatic primary amine developing agent, TIME is a timing group, n is 0 or a positive integer, Dye is a dye radical, and X is an auxochrome radical of the dye. When the bond between Cp and $(TIME)_n$ cleaves the timing group in $\ominus(TIME)_n$—X—Dye (precursor) automatically releases $\ominus$X-Dye (dye moiety) due to electron transfer or intramolecular nucleophilic reaction.

The coupler of formula (I), when color developed after imagewise exposure in a color photogrpahic material, undergoes a coupling reaction with an oxidized product of a developing agent which is formed imagewise, thereby forming an imagewise color image. This color image is composed of two different substance formed from one coupler. The first substance is a dye which has been utilized in the conventional color photographic material; i.e., indophenol, indoaniline, indamine, azomethine, phenoxadine, phenadine, similar dyes or a colorless substance (when Cp is a colorless coupler radical) as formed by the coupling with an oxidized product of an aromatic primary amine-based developing agent. The second substance is a dye which is formed by bond cleavage between Cp and $(TIME)_n$ simultaneously with the above first substance at the time of the coupling reaction. Properties imparted to the second dye permit to provide great effects such as an increase in color image density, an improvement in hue and an increase in fastness of color image to the color photographic material. In particular, the effect of increasing the color image density is great. When the color image densities of the first and second dyes are equal, the coupler of the present invention produces a color image density which is nearly twice that resulting from one conventional coupler. As a result of an increase in color image density, the amounts of silver halide and the coupler used in the color photographic material can be decreased. Consequently, the sharpness can be greatly increased by decreasing the thickness of the color photographic material. It has been found, however, that although the sharpness is increased by decreasing the layer thickness, graininess is deteriorated. As a result of extensive investigations, it has been found that when a method of using in combination with the coupler a compound releasing a development inhibitor (DIR compound) or its precursor directly or through a timing group upon their reaction with an oxidized developing agent, which is well known in the art and commonly used to improve the graininess, is applied to the coupler of the present invention, the graininess can be improved to an extent that could not be expected from the results of improvement of graininess when couplers commonly used in the art and DIR compounds are used in combination. The object of the present invention can be achieved by using such compounds in combination, and there can thus be obtained a silver halide color light-sensitive material which is improved in both the sharpness and graininess.

The present invention is hereinafter explained in further detail.

The coupler radical represented by Cp in formula (I) forms either a dye or a colorless substance through a coupling reaction with an oxidized product of an aromatic primary amine-based developing agent (the latter is a so-called non-color-forming coupler radical). Cp contains an anti-diffusing group, or does not contain an anti-diffusing group, or contains an alkali solubilization group.

When $n \geqq 1$, the timing group represented by TIME represents a divalent or trivalent organic group connecting the coupling portion of Cp and —X—Dye. When $n=0$, —X—Dye is linked directly to the coupling portion of Cp. When $n \geqq 2$, timing groups may be the same or different from each other. Preferably, n is not more than 2.

As a mechanism of releasing —X—Dye when the coupler contains TIME, there can be listed those disclosed as photographically useful group (hereinafter abbreviated to "PUG")—releasing timing type couplers.

There can be listed, for example, a method as described in U.S. Pat. No. 4,248,962 in which PUG is released by the intramolecular nucleophilic substitution reaction after the releasing process, a method as described in Japanese Patent Application (OPI) Nos. 114946/81, 154234/82 and 188035/82 in which PUG is released by electron transfer along the conjugated system after the releasing process, a method as described in Japanese Patent Application (OPI) Nos. 56837/82 and 209740/83 in which an intramolecular nucleophilic substitution reaction is caused by a nucleophilic group newly formed by electron transfer along the conjugated system after the releasing process, whereupon PUG is released, and a method as described in Japanese Patent Application (OPI) Nos. 218645/85 and 232549/85 in which after the releasing process, PUG is released by cleavage of hemiacetal.

The coupler of the present invention includes, as well as the compounds represented by formula (I), the following compounds containing a trivalent timing group. Examples include compounds as described in Japanese Patent Application (OPI) No. 209740/83 in which Cp and TIME are linked at the non-coupling site of Cp and even after the coupling reaction with an oxidized product of a developing agent and subsequent reactions (when a timing group is contained TIME cleaves from X-Dye), Cp and TIME are still bound together. In addition, compound further containing a bond in which TIME and Dye are not cleaved even after the coupling reaction of the oxidized product of a developing agent and the subsequent reactions are included. Such compounds are disclosed in Japanese Patent Application (OPI) Nos. 232549/85, 233649/85, 237446/85 and 237447/85. In all of the above cases, a bond not cleaving even after the coupling reaction with the oxidized product of a developing agent and the subsequent reactions may be further contained between Cp and Dye.

In formula (I) such bonds which do not cleave may be present between Cp and TIME, and TIME and Dye.

Examples of the auxochrome radical represented by X are hetero atoms such as an oxygen atom, a nitrogen atom and a sulfur atom.

The dye radical represented by Dye is shifted in its maximum absorption wavelength to the shorter wavelength side by blocking with Cp or TIME.

It is preferable to shift the wavelength in such an extent that the difference of the wavelengths of the dye before the bond cleavage due to the reaction with an oxidized product of a developer and after that is at least 20 nm, and preferably at least 40 nm.

Dyes which contain such dye radical can be chosen from the dyes described, for example, in J. Fabian and H. Hartmann, *Light Absorption of Organic Colorants*, published by Springer-Verlag Co., but are not limited thereto.

More desirable dyes are those which have a suitable hue in a cleaved state of the auxochrome (⊖X—Dye).

Preferred dyes are hydroxy group-substituted aromatic azo dyes or hydroxy group-substituted heterocyclic aromatic azo dyes having a radical represented by formula (II)

$$-X-Y-N=N-Z \qquad \text{(II)}$$

wherein X is the same as defined for formula (I), Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

In formula (II), X is preferably an oxygen atom or a sulfur atom.

In formula (II), Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be a benzene condensed ring. The heterocyclic group means groups having a ring structure such as pyrrole, thiophene, furan, imidazole, 1,2,4-triazole, oxazole, thiadiazole, pyridine, indole, benzothiophene, benzoimidazole, or benzooxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio group, an arylthio group, a hterocyclic group, a sulfonyl group, a halogen atom, a nitro group, a nitroso group, a cyano group, —COOM (M:H, an alkali metal atom or $NH_4$), a hydroxyl group, a sulfonamide group, an alkoxyl group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In a case that Z is a substituted aryl group or a substituted unsaturated heterocyclic group, as substituents, groups as listed for Y can be used in the same manner as for Y.

When Y and Z contain an aliphatic or alicyclic hydrocarbon moiety as a substituent, any of substituted or unsubstituted, saturated or unsaturated or straight or branched groups having from 1 to 32, preferably from 1 to 20 carbon atoms, in the case of aliphatic hydrocarbon moiety, and having from 5 to 32, preferably from 5 to 20 carbon atoms in the case of alicyclic hydrocarbon moiety can be used. When substitution is carried out repeatedly, the uppermost number of carbon atom of the thus obtained substituent is preferably 32.

When Y and Z contain an aryl moiety as a substituent, the number of carbon atoms of the moiety is generally from 6 to 10, and preferably it is a substituted or unsubstituted phenyl group.

In the present invention groups in formula shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamide group, an acyloxy group and the like each is aliphatic alicyclic, and aromatic group.

Preferred examples of this group represented by formula (II) are shown below.

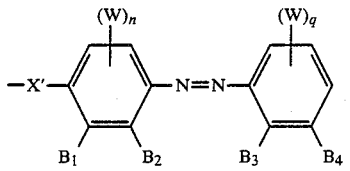

(D-1)

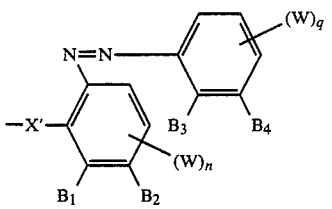

(D-2)

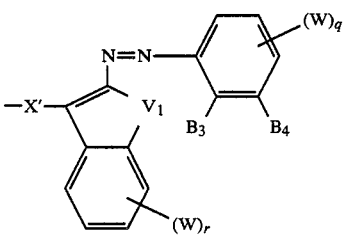

(D-3)

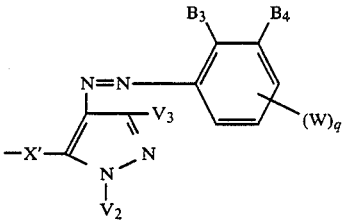

(D-4)

-continued (D-5)

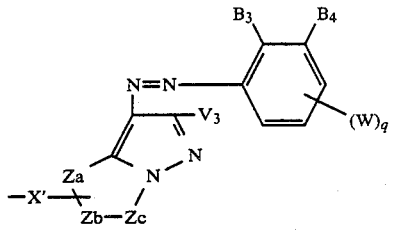

(D-6)

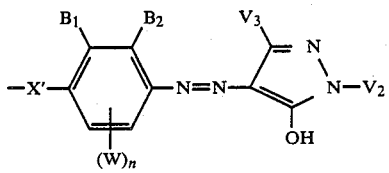

In the above formulae, X' is an oxygen atom or a sulfur atom, W is a substituent selected from the substituents listed for Y and Z in formula (II), n is 0, 1, or 2, q is 0, 1, 2 or 3, and r is 0 or an integer of 1 to 4. $B_1$, $B_2$, $B_3$, and $B_4$ are each a hydrogen atom or a substituent as defined for W, or $B_1$ and $B_2$, and $B_3$ and $B_4$ may combine together to form a condensed ring. When they indicate a benzene condensed ring, it may be substituted with a group represented by W.

In the above formulae, when the total number of W is 2 or more, W may be the same or different.

$V_1$ is an oxygen atom, a sulfur atom, or an imino group, which may be substituted. Examples of the substituent include aliphatic- and alicyclic-hydrocarbon group, an aryl group and a heterocyclic group.

$V_2$ is an aliphatic- or alicyclic hydrocarbon radical, an aryl group, or a heterocyclic radical. When $V_2$ is an aliphatic- or alicyclic-hydrocarbon radical, may be saturated or unsaturated, and aliphatic hydrocarbon radical may be straight, or branched. The group represented by $V_2$ preferably has at most 22 carbon atoms. Preferably it is an alkyl group (e.g., a methyl group, an ethyl group, an isopropyl group, a butyl group, a dodecyl group, an octadecyl group, and a cyclohexyl group), or an alkenyl group (e.g., an allyl group and an octenyl group). (In the present invention when the carbon number of a group is shown only by the uppermost number the lowermost number is the lowest number that the group can provide. The lowermost numbers of carbon atoms of groups, for example, an alkyl group, an aryl group, an aralkyl group, an alkenyl group, a cycloalkyl- or alkenyl group are always 1, 6, 7, 5 and 2, respectively.

Preferred examples of the aryl group are a phenyl group and a naphthyl group, and examples of the heterocyclic group are a pyridinyl group, a quinolyl group, a thienyl group, a piperidinyl group, and an imidazolyl group.

As substituents to be introduced in the aliphatic- or alicyclic-hydrocarbon radical, the aryl group, and the heterocyclic group, the groups listed for Y in formula (II) can be used.

$V_3$ has at most 32 carbon atoms, preferably at most 22 carbon atoms, and is a straight or branched alkyl or alkenyl group, a cycloalkyl group an aralkyl group, a cycloalkenyl group, an aryl group, a heterocyclic group, an alkoxycarbonyl group (e.g., a methoxycarbonyl group and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxyl group (e.g., a methoxy group, an ethoxy group, and a heptadecyloxy group), an aryloxy group (e.g., a phenoxy group and a tolyloxy group), an acylamino group (e.g., an acetylamino group, and a 3-[2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group, a mono-, di-, or tri-substituted ureido group (e.g., an N-arylureido group, and an N-alkylureido group), a mono- or di-alkylamino group (e.g., an n-butylamino group, a methylamino group and a cyclohexylamino group), a cycloamino group (e.g., a piperidino group and a pyridino group), or a sulfonamido group (e.g., an alkylsulfonated group and an arylsulfonacid group). These groups may be substituted with the substituents listed for Y in formula (II) in the same manner as disclosed hereinbefore to form substituted groups having at most 32 carbon atoms.

$V_3$ further represents a halogen atom (e.g., a chlorine atom and a bromine atom), or a cyano group.

Za, Zb, and Zc are each a methine group, a substituted methine group, =N— or —NH—, and one of the Za—Zb and Zb–Zc bonds is a double bond and the other is a single bond, provided that Za, Zb, and Zc are not N at the same time. When the Zb–Zc is a carbon-carbon double bond, it may constitute part of an aromatic ring (e.g., a benzene or naphthalene ring), and this aromatic ring may be substituted with the groups listed for Y.

Any one of Za, Zb, and Zc combines with X' to form —X'-C=.

The effects of the present invention are obtained especially effectively when, in formula (I), Cp is a coupler radical represented by the formulae (III), (IV), (V), (VI), (VII), (VIII), (IX), (X), (XI), (XII), or (XIII). These couplers are preferred in that they increase the coupling speed.

Formula (III)

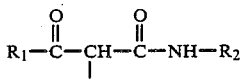

Formula (IV)

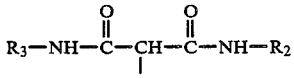

Formula (V)

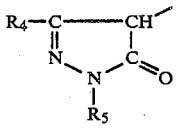

Formula (VI)

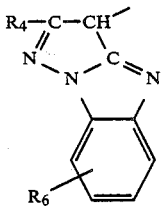

-continued

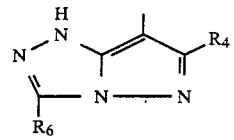

Formula (VII)

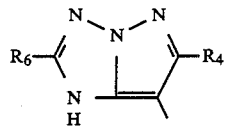

Formula (VIII)

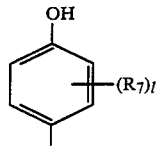

Formula (IX)

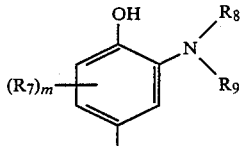

Formula (X)

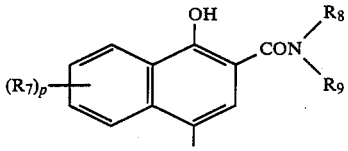

Formula (XI)

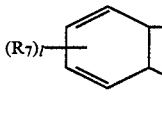

Formula (XII)

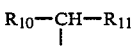

Formula (XIII)

A free bond from the coupling site in the above formulae indicates a position to which the coupling release group is linked. In the above formulae, when $R_1$, $R_2$, $R_3$, $R_4$, $R_5$, $R_6$, $R_7$, $R_8$, $R_9$, $R_{10}$ or $R_{11}$ contains an antidiffusing group, it is selected so that the total number of carbon atoms is from 8 to 32, and preferably from 10 to 22.

$R_1$ to $R_{11}$, l, m, and p in formula (III) to (XIII) are hereinafter further explained.

$R_1$ represents an aliphatic- or alicyclic-hydrocarbon group, an aryl group, an alkoxyl group, or a heterocyclic group, and $R_2$ and $R_3$ each represents an aryl group or a heterocyclic group.

The aliphatic- or alicyclic hydrocarbon group represented by $R_1$ preferably has at most 22 carbon atoms, may be substituted or unsubstituted, and aliphatic hydrocarbon may be straight or branched. Preferred examples of the substituent for these groups represented by $R_1$ are an alkoxy group, an aryloxy group, an amino group, an acylamino group, and a halogen atom. These substituents may be further substituted with at least one of these substituents repeatedly. Useful examples of the groups as $R_1$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, and the like.

When $R_1$, $R_2$, or $R_3$ is an aryl group (especially a phenyl group), the aryl group may be substituted. The aryl group (e.g., a phenyl group) may be substituted with groups having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R_1$, $R_2$, or $R_3$ may be substituted with an amino group which may be further substituted with a lower alkyl group having from 1 to 6 carbon atoms, a hydroxyl group, —COOM and —$SO_2M$ (M:H, an alkali metal atom, $NH_4$), a nitro group, a cyano group, a thiocyano group, or a halogen atom.

$R_1$, $R_2$, or $R_3$ may represent substituents resulting from condensation of a phenyl group with other rings, such as a naphthyl group, a quinolyl group, an isoquinolyl group, a curomanyl group, a commercial group, and a tetrahydronaphthyl group. These substituents may be further substituted repeatedly with at least one of above-described substituents for the phenyl group represented by $R_1$, $R_2$ or $R_3$.

When $R_1$ represents an alkoxy group, the alkyl moiety of the alkoxyl group can be a straight or branched alkyl group, an alkenyl group, a cycloalkyl group, or a cycloalkenyl group each having at most 32 carbon atoms, preferably at most 22 carbon atoms. These substituents may be substituted with groups such as halogen atom, an aryl group and an alkoxyl group to form a group having at most 32 carbon atoms.

When $R_1$, $R_2$, or $R_3$ represents a hydrocyclic ring, the heterocyclic group is linked to a carbon atom of the carbonyl group of the acyl group in alpha-acylacetamido or to a nitrogen atom of the amido group through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents in the ring thereof. Examples of the substituents include those defined for the aryl group represented by $R_1$, $R_2$ and $R_3$.

In formula (V), $R_5$ is a group having at most 32 carbon atoms, preferably at most 22 carbon atoms, and it is a straight or branched alkyl group (e.g., a methyl group, an ixopropyl group, a tert-butyl group, a hexyl group and a dodecyl group), an alkenyl group (e.g., an allyl group), a cycloalkyl group (e.g., a cyclopentyl group, a cyclohexyl group and a norbornyl group), an aralkyl group (e.g., a benzyl group and a β-phenylethyl group), or a cycloalkenyl group (e.g., a cyclopentenyl group and a cyclohexenyl group). These groups may be further substituted with groups such as a halogen atom, a nitro group, a cyano group, an aryl group, an alkoxyl group, an aryloxy group, —COOM (M:H, an alkali metal atom, $NH_4$) an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamide group, a heterocyclic group, an arylsulfonyl group , an alkylsulfonyl group, an arylthio group, an alkylthio group, an alkylamino group, a dialkylmino group, an anilino group, an N-arylanilino group, an N-alkylanilino group, an N-acylanilino group, a hydroxyl group, and a mercapto group.

Furthermore $R_5$ may represent an aryl group (e.g., a phenyl group and an α- or β-naphthyl group). This aryl group may be substituted with at least one group. Examples of such substituents are an alkyl group, an alkenyl group, a cycloalkyl group, an aralkyl group, a cycloalkenyl group, a halogen atom, a nitro group, a cyano group, an aryl group, an alkoxyl group, an aryloxy group, —COOM (M:H, an alkali metal atom, $NH_4$), an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, alkylsulfonyl group, an arylthio group, an alkylthio group, an alkylamino group, a dialkylamino group, an anilino group, an N-alkylanilino group, an N-arylanilino group, an N-acylanilino group, a hydroxyl group, and a mercapto group. More preferred as $R_5$ is a phenyl group which is substituted with at least one of the groups such as an alkyl group, an alkoxyl group, and a halogen atom in at least one ortho-position, because it decreases color formation due to light or heat of the coupler remaining in a film member.

Furthermore, $R_5$ may represents a heterocyclic group (e.g., 5- or 6-membered heterocyclic rings and condensed heterocyclic groups containing at least one hetero atom i.e., a nitrogen atom, an oxygen atom or a sulfur atom, such as a pyridyl group, a quinolyl group, a furyl group, a benzothiazolyl group, an oxazolyl group, an imidazolyl group, and a naphthooxazolyl group), a heterocyclic group substituted with a group as listed for the above aryl group represented by $R_5$, an aliphatic, alicyclic or aromatic acyl group, an alkylsulfonyl group, an arysulfonyl group, an alkylcarbamoyl group, an arylcarbamoyl group, an alkylthiocarbamoyl group, or an arylthiocarbamoyl group.

$R_4$ represents a hydrogen atom, and represents groups having at most 32 carbon atoms, preferably at most 22 carbon atoms, such as a straight or branched alkyl group, an alkenyl a cycloalkyl group, an aralkyl group, a cycloalkenyl group (these groups may have a substituent or substituents as listed for $R_5$), an aryl group, a heterocyclic group (these groups may have a substituent or substituents as listed for $R_5$), an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group, and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an α-naphthylthio group), —COOM(M:H, alkali metal atom, $NH_4$), an acylamino group (e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group, a substituted ureido group (e.g., an N-arylureido group, and an N-alkylureido group), a urethane group, a thiourethane group, an arylamino group (e.g., a phenylamino group, an N-methylanilino group, a di-phenylamino group, an N-acetylanilino group, and a 2-chloro-5-tetradecaneamidoanilino group), an alkylamino group (e.g., an n-butylamino group, a methylamino group and a cyclohexylamino group), a cycloamino group (e.g., a piperidino group, and a pyrrolidino group), a heterocyclic amino group (e.g., a 4-pyridylamino group and a 2-benzooxazolidyl amino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group, an N-methyl-N-phenylcarbamoyl group and an N-phenylcarbamoyl group), a sulfamoyl group (e.g., an N-alkylsulfamoyl group, an N,N-dialkylsulfamoyl group, an N-arylsulfamoyl, an N-alkyl-N-arylsulfamoyl group, and an N,N-diarylsulfamoyl group), a cyano group, a hydroxyl group, a mercapto group, a halogen atom, or a sulfo group.

$R_6$ represents a hydrogen atom, and represents groups having at most 32 carbon atoms, preferably at most 22 carbon atoms, such as a straight or branched alkyl group, an alkenyl group, a cycloalkyl group, an aralkyl group, or a cycloalkenyl group. These groups may be substituted with a group or groups as listed for $R_5$.

$R_6$ may be an aryl group or a heterocyclic group. These groups may be substituted with a group or groups as listed for $R_5$.

$R_6$ may be a cyano group, an alkoxyl group, an aryloxy group, a halogen atom, —COOM(M:H, an alkali metal atom, $NH_4$), an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-aryl-anilino group, an N-alkylanilino group, an N-acylanilino group, a hydroxyl group, or a mercapto group.

$R_7$, $R_8$, $R_9$ each represents a group as is conventionally used in 4-equivalent phenol or α-naphthol couplers.

$R_7$, $R_8$ and $R_9$ each may have at most 32 carbon atoms, and preferably at most 22 carbon atoms.

More specifically, $R_7$ represents a hydrogen atom, a halogen atom, an alkoxycarbonylamino group, an aliphatic or alicyclic-hydrocarbon group, an N-arylureido group, an acylamino group, a group —O—$R_{12}$ or a group —S—$R_{12}$ (wherein $R_{12}$ is an aliphatic- or alicyclic-hydrocarbon radical). When two or more of the groups of $R_7$ are contained in one molecule, they may be different, and the aliphatic- and alicyclic-hydrocarbon radical may be substituted. In a case that these substituents contain an aryl group, the aryl group may be substituted with a group or groups as listed for $R_5$.

$R_8$ and $R_9$ each represents a group selected from an aliphatic- or alicyclic-hydrocarbon radial, an aryl group, and a heterocyclic group, or one or $R_8$ and $R_9$ may be hydrogen atom. The above groups may be substituted. $R_8$ and $R_9$ may combine together to form a nitrogen-containing heterocyclic nucleus.

The aliphatic- and alicyclic-hydrocarbon radical may be saturated or unsaturated, and the aliphatic hydrocarbon may be straight or branched. Preferred examples are an alkyl group (e.g., a methyl group, an ethyl group, an isopropyl group, a butyl group, a tert-butyl group, an isobutyl group, a dodecyl group, an octadecyl group, a cyclobutyl group and a cyclohexyl group), and an alkenyl group (e.g., an allyl group and an octenyl group). Typical examples of the aryl group are a phenyl group and a naphthyl group, and typical examples of the heterocyclic radical are a pyridinyl group, a quinolyl group, a thienyl group, a piperidyl group, and an imidazolyl group. Groups to be introduced in these aliphatic hydrocarbon radical, aryl group and heterocyclic radical include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

l is an integer of 1 to 4, m is an integer of 1 to 3, and p is an integer of 1 to 5.

$R_{10}$ represents group having at most 32 carbon atoms and preferably at most 22 carbon atoms. $R_{10}$ represents an arylcarbonyl group, an alkanoyl group, an alkanecarbamoyl group, an alkoxycarbonyl group, or an aryloxycarbonyl group. These groups may be substituted with groups such as an alkoxyl group, an alkoxycarbonyl group, an acylamino group, an alkylsulfamoyl group, an alkylsulfonamido group, an alkylsuccinimide group, a halogen atom, a nitro group, a carboxyl group, a nitrile group, an alkyl group, and an aryl group.

$R_{11}$ represents groups having at most 32 carbon atoms, and preferably at most 22 carbon atoms. $R_{11}$ represents an arylcarbonyl group, an alkanoyl group, an arylcarbamoyl group, an alkanecarbamoyl group, an alkoxycarbonyl group, and aryloxycarbonyl group, an alkanesulfonyl group, an arylsulfonyl group, an aryl group, or a 5- or 6-membered heterocyclic group (containing a hetero atom selected from a nitrogen atom, an oxygen atom, and a sulfur atom, e.g., a triazolyl group, an imidazolyl group, a phthalimido group, a succineimido group, a furyl group, a pyridyl group, and a benzotriazolyl group). These groups may be substituted with a group or groups as listed for $R_{10}$.

The above described substituted groups in formulae III-XIII may further substituted repeatedly once, twice or more with a group selected from the same group of the substituents to form substituted groups having preferably at most 32 carbon atoms.

Particularly preferable timing groups of Time in formula (I) are represented by the following formulae wherein symbol * expresses the position at which Cp is bonded, and symbol ** expresses the position at which X-Dye is bonded. The Time may be the combination of the following two or more formulae.

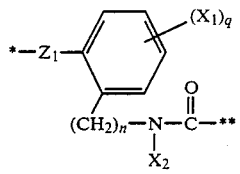

(T-1)

wherein $Z_1$ represents

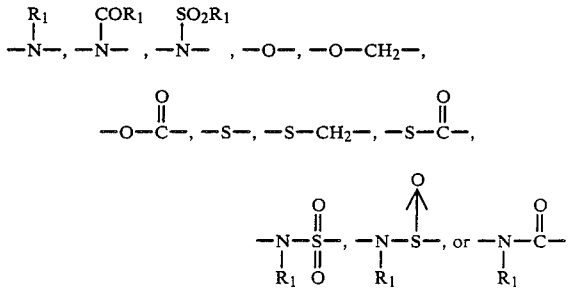

wherein $R_1$ is a hydrogen atom, an aliphatic, alicyclic, or aromatic hydrocarbon group, or a heterocyclic group; $X_1$ represents an aliphatic, alicyclic or aromatic hydrocarbon group or a heterocyclic group,

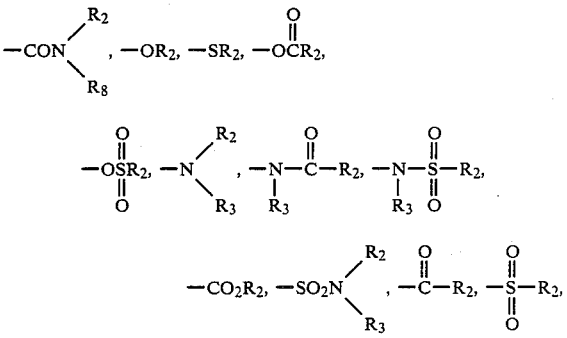

a cyano group, halogen atoms (e.g., fluorine, chlorine, bromine, and iodine) or a nitro group wherein $R_2$ and $R_3$ may be or may not be identical and express the same groups as described for $R_1$; $X_2$ represents the same groups as described for $R_1$: q represents an integer of from 0 to the total number of hydrogen atoms in the ring which are able to be substituted (in formula (T-1) q represents an integer of from 0 to 4), and when q is 2 or more, the substituent represented by $X_1$ may be or may not be identical, and when q is 2 or more, $X_1$ may link to each other to form a ring; and n represents 0, 1 or 2.

The groups represented by formula (T-1) are, for example, described in U.S. Pat. No. 4,248,962.

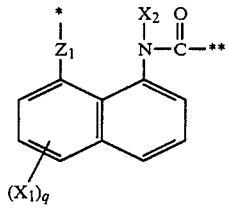

(T-2)

wherein $Z_1$, $X_1$, $X_2$ and q denote the same meanings as those defined for formula (T-1).

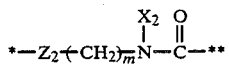

(T-3)

wherein $Z_2$ represents

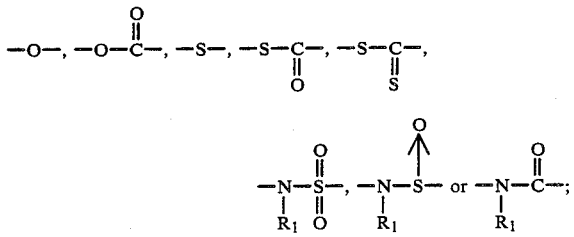

m is an integer of from 1 to 4, preferably being 1, 2 or 3; and $R_1$ and $X_2$ denote the same meanings as those defined for formula (T-1).

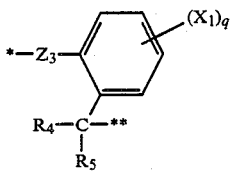

(T-4)

wherein $Z_3$ represents —S— or

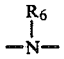

wherein $R_6$ expresses an aliphatic, alicyclic or aromatic hydrocarbon group, acyl, sulfonyl or heterocyclic group; $R_4$ and $R_5$ denote the same meanings as $R_1$ defined for formula (T-1); and $X_1$ and q denote the same meanings as those defined for formula (T-1).

An example of the group represented by formula (T-4) is the timing group described in U.S. Pat. No. 4,409,323.

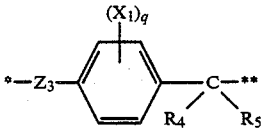

(T-5)

wherein $Z_3$, $X_1$, $R_4$, $R_5$, and q denote the same meanings as those defined for formula (T-4).

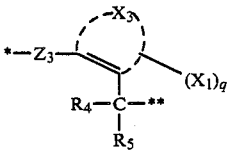

(T-6)

wherein $X_3$ is an atomic group which comprises at least one atom selected from the class consisting of carbon, nitrogen, oxygen and sulfur and which is necessary to form a 5- to 7-membered heterocyclic group, which may be further condensed with a benzene ring or a 5- to 7-membered heterocyclic group, exemplarily preferable heterocyclic groups being pyrrole, pyrazole, imidazole, triazole, furan, oxazole, thiophene, thiazole, pyridine, pyridazine, pyrimidine, pyrazine, azepin, oxepin, indole, benzofuran, and quinoline; and $R_4$, $R_5$, $Z_3$, $X_1$ and q denote the same meanings as those defined for formula (T-4).

An example of the group represented by formula (T-6) is the timing group described in British Pat. No. 2,096,783.

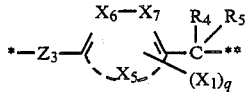

(T-7)

wherein $X_5$ is an atomic group which comprises at least one atom selected from the class consisting of carbon, nitrogen, oxygen, and sulfur and which is necessary to form a 5- to 7-membered heterocyclic group, which may be condensed further with a benzene ring or a 5- to 7-membered heterocyclic group, exemplarily preferable heterocyclic groups including pyrrole, imidazole, triazole, furan, oxazole, oxadiazole, thiophene, thiazole, thiadiazole, pyridine, pyridazine, pyrimidinie, pyrazine, azepin, oxepin, and isoquinoline; $X_6$ and $X_7$ is

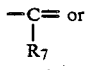

—N= wherein $R_7$ expresses a hydrogen atom, an aliphatic-, alicyclic- or aromatic-hydrocarbon group; and $R_4$, $R_5$, $Z_3$, $X_1$ and q denote the same meanings as those defined for formula (T-4).

(T-8)

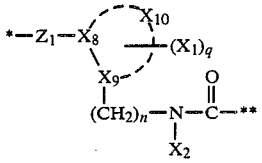

wherein $X_{10}$ is an atomic group which comprises at least one atom selected from the class consisting of carbon, nitrogen, oxygen, and sulfur and which is necessary to form a 5- to 7-membered heterocyclic group, which may be further condensed with a benzene ring or a 5- to 7-membered heterocyclic group, exemplarily preferable heterocyclic group being pyrrolidine, piperidine, and benzotriazole besides those given for formula (T-6); $X_8$ and $X_9$ are

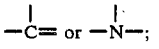

and $Z_1$, $X_1$, $X_2$, n and q denote the same meanings as those defined for formula (T-1).

(T-9)

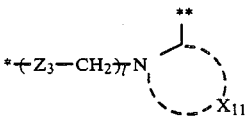

wherein $X_{11}$ denotes the same meaning as $X_{10}$ defined for formula (T-8); $Z_3$ denotes the same meaning as that defined for formula (T-4) and l expresses 0 or 1. Exemplarily preferable heterocyclic groups including $X_{11}$ are as follows.

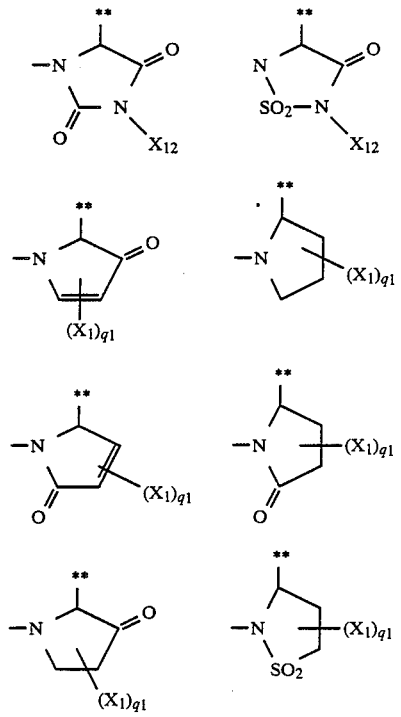

wherein $q_1$ represents an integer of 1 and 2, $X_1$ denotes the same meaning as those defined for formula (T-1); and $X_{12}$ represents a hydrogen atom, an aliphatic-, alicyclic-, or aromatic-hydrocarbon group, an acyl, sulfonyl, alkoxycarbonyl, sulfamoyl, heterocyclic, or carbamoyl group.

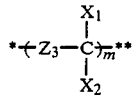

(T-10)

wherein $X_1$ and $X_2$ denote the same meanings as those defined for formula (T-1), $Z_3$ denotes the same meaning as that for formula (T-4) and m denotes the same meaning as that for formula (T-3) and is preferably 1 or 2.

In the above formulae (T-1) to (T-10), $X_1$, $X_2$, $R_1$ to $R_7$ have preferably from 1 to 20 carbon atoms, and may be saturated or unsaturated, substituted or unsubstituted, straight or branched chain when they contain an aliphatic hydrocarbon moiety, and have preferably 5 to 20 carbon atoms and may be saturated or unsaturated, substituted or unsubstituted when they have an alicyclic hydrocarbon moiety. The above $X_1$, $X_2$, $R_1$ to $R_7$ have from 6 to 20 carbon atoms, preferably from 6 to 10 carbon atoms, and are preferably a substituted or unsubstituted phenyl group when they contain an aromatic hydrocarbon moiety. The above $X_1$, $X_2$, $R_1$ to $R_7$ are 5- or 6-membered heterocyclic groups having as hetero atoms at least one member of the group consisting of nitrogen, oxygen and sulfur atoms when they contain a heterocyclic moiety. Examples of the preferable heterocyclic groups are a pyridyl, furyl, thienyl, triazolyl, imidazolyl, pyrazolyl, thiadiazolyl, oxadiazolyl or pyrrolidinyl group.

Examples of the preferred timing groups are as follows:

(1)

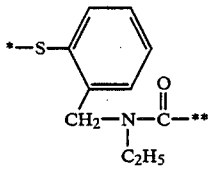

(2)

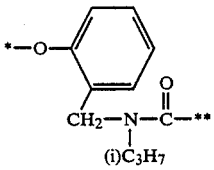

(3)

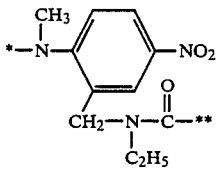

(4)

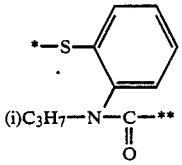

(5)

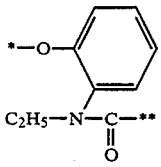

(6)

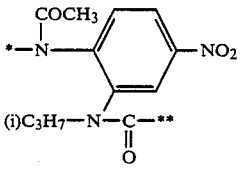

-continued
(7)
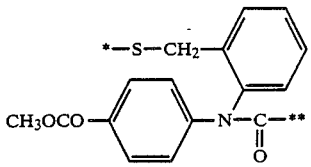
(8)
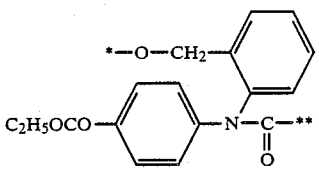
(9)
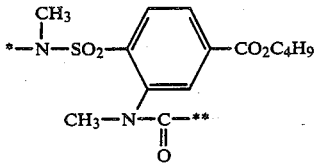
(10)
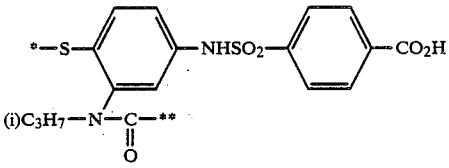
(11)
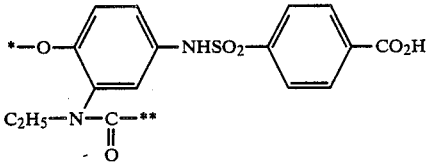
(12)
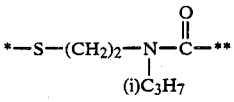
(13)
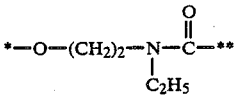
(14)
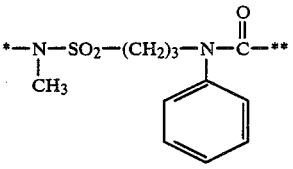
(15)
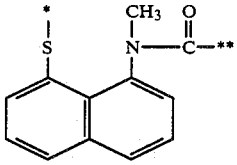
(16)
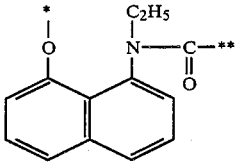
(17)
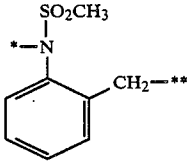
(18)
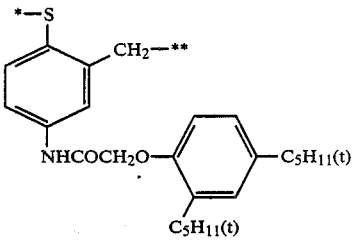
(19)
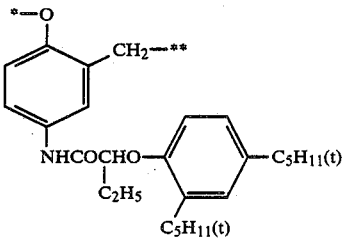
(20)
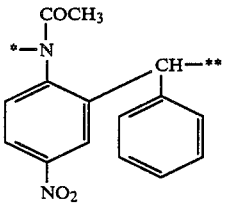
(21)
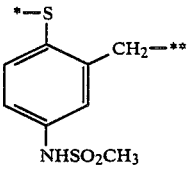
(22)
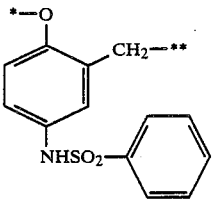

-continued
(23)
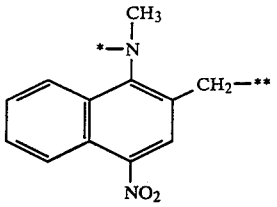
(24)
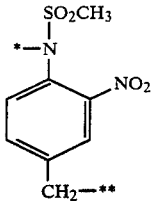
(25)
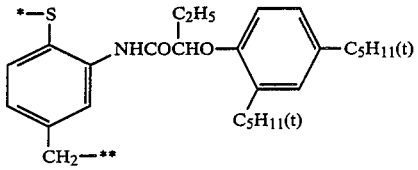
(26)
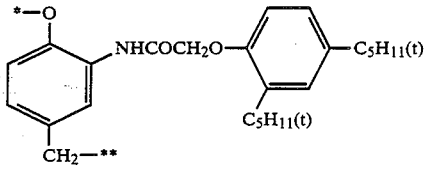
(27)
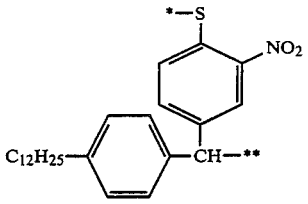
(28)
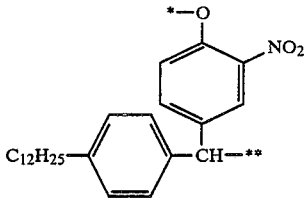
(29)
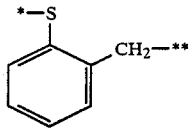
(30)
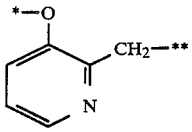
(31)
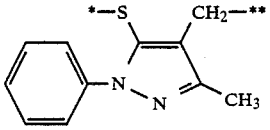
(32)
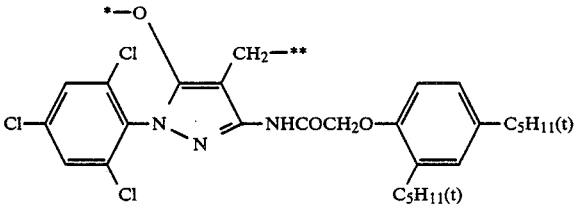
(33)
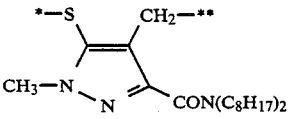
(34)
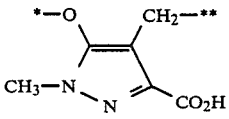
(35)
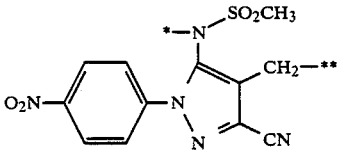
(36)
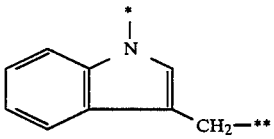

-continued

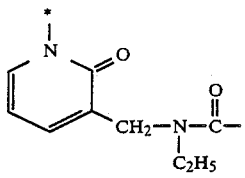

(37)

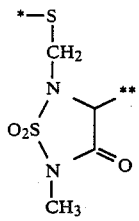

(38)

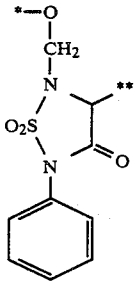

(39)

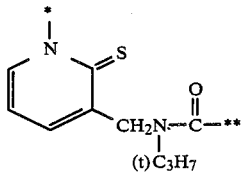

(40)

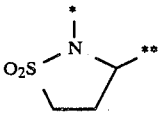

(41)

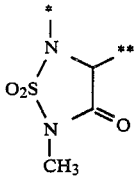

(42)

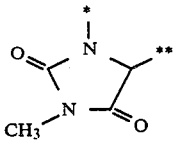

(43) *—S—CH2—**

(44)

*—O—CH2—**

(45)

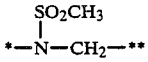

(46)

*—S—CH—**
CO2C2H5

(47)

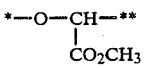

(48)

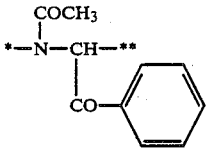

(49)

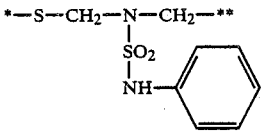

(50)

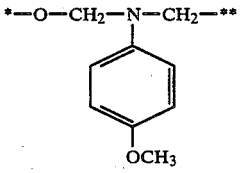

(57)

When Cp of formula (I) has an anti-diffusing group, an anti-diffusing colored or colorless compound is formed after the coupling reaction with an oxidized product of an aromatic primary amine developing agent. On the other hand, when Cp has a non-anti-diffusing group, a compound formed by the coupling reaction processes diffusing properties depending on the non-anti-diffusing group contained in Cp. When Cp contains an alkali-solubilized group, a compound formed by the coupling reaction is eluted from the film.

The couplers represented by formula (I) include polymers. That is, they are polymers having a repeating unit represented by formula (XV) as derived from a monomer coupler represented by formula (XIV), or copolymers with at least one non-color-forming monomer not having an ability to couple with an oxidized product of an aromatic primary amine developing agent, and containing at least one ethylene group. Two or more of the monomer couplers may be polymerized at the same time.

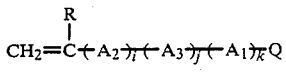

(XIV)

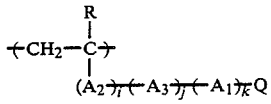

(XV)

In the above formulae, R represents a hydrogen atom, a lower alkyl group having from 1 to 4 carbon atoms, or a chlorine atom, $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—, $A_2$ represents —CONH— or —COO—, and $A_3$ represents a substituted or unsubstituted, straight or branched alkylene group, a substituted or unsubstituted aralkylene group, or a substituted or unsubstituted arylene group, and $A_3$ has at most 10 carbon atoms. Examples of the alkylene groups are a methylene group, a methylmethylene group, a dimethylmethylene group, a dimethylene group, a trimethylene group, a tetramethylene group, a pentamethylene group, a hexamethylene group, a decylmethylene group, and the like. An example of the aralkylene group is benzylidene. Examples of the arylene group are a phenylene group and a naphthylene group.

Q represents a compound radical represented by the general formula (I) and may be linked at any site of Cp, TIME and Dye.

i, j and k are each 0 or 1, but they are not all 0 at the same time.

Substituents for the alkylene group, aralkylene group or arylene group represented by $A_3$ include an aryl group (e.g., a phenyl group), a nitro group, a hydroxyl group, a cyano group, a sulfo group, an alkoxyl group (e.g., a methoxy group), an aryloxy group (e.g., a phenoxy group), an acyloxy group (e.g., an acetoxy group), an acylamino group (e.g., an acetylamino group), a sulfonamido group (e.g., a methanesulfonamido group), a sulfamoyl group (e.g., a methylsulfamoyl group), a halogen atom (e.g., a fluorine atom, a chlorine atom and a bromine atom), a carboxyl group, a carbamoyl group (e.g., a methylcarbamoyl group), an alkoxycarbonyl group (e.g., a methoxycarbonyl group), and a sulfonyl group (e.g., a methylsulfonyl group). When there are two or more substituents, they may be the same or different.

Non-color-forming ethylenical monomers not undergoing the coupling reaction with an oxidided product of an aromatic primary amine developing agent include acrylic acid, α-chloroacrylic acid, α-alkylacrylic acid and their ester and amide derivatives, methylenebisacrylamide, vinyl esters, acrylonitrile, aromatic vinyl compounds, maleic acid derivatives, and vinylpyridines. Two or more of these non-color-forming ethylenically unsaturated monomers can be used at the same time.

The layer of the above coupler added is at least one of light-sensitive silver halide-containing layer and its adjacent layer.

The amount of the coupler added is preferably from 0.001 to 1 mol per mol of silver halide contained in the layer containing the coupler, when it is added to the light-sensitive silver halide-containing layer and/or an adjacent layer containing non-light sensitive silver halide. Especially preferably the amount of the coupler added is from 0.005 to 0.5 mol.

Preferred examples of the couplers represented by formula (I) are shown below, although the present invention is not limited thereto.

Examples of couplers recovering a yellow dye as a result of cleavage between TIME (when n≧1) or Cp (when n=0) and X are as follows.

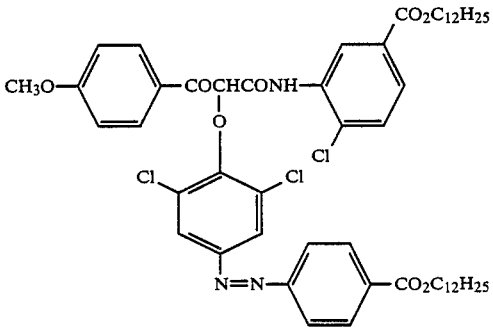

Y-1

-continued
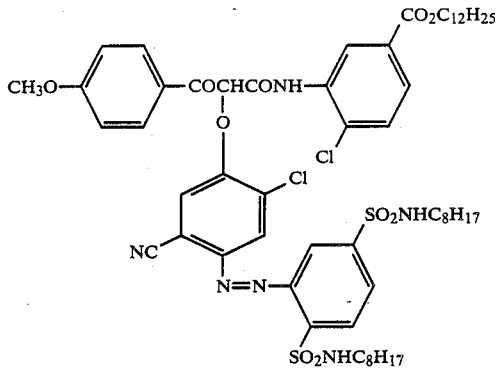
Y-2
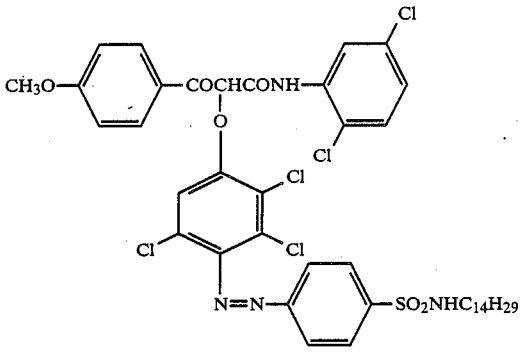
Y-3
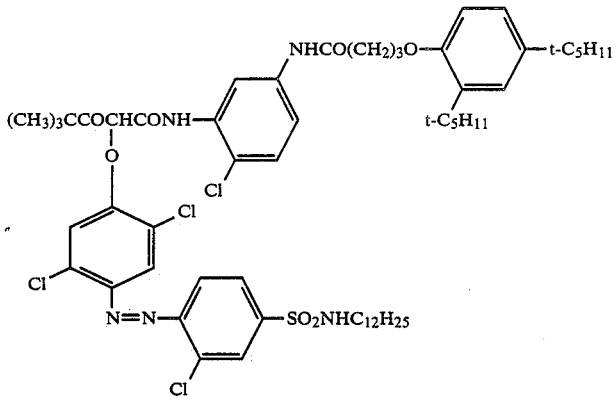
Y-4
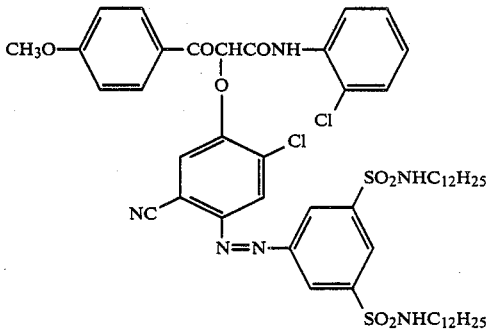
Y-5

-continued
Y-6
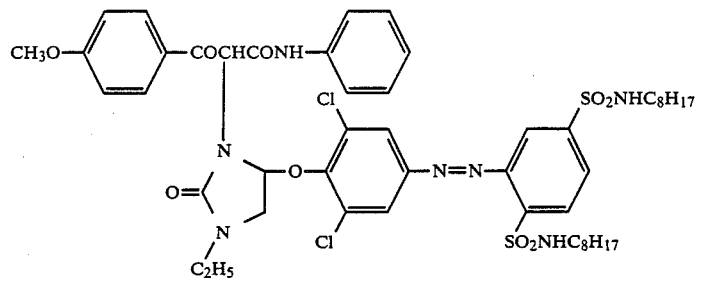
Y-7
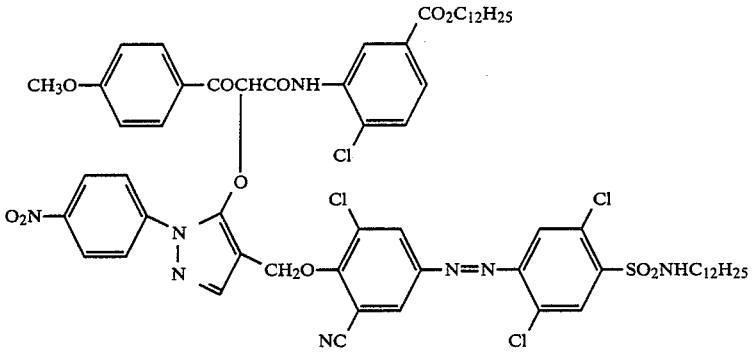
Y-8
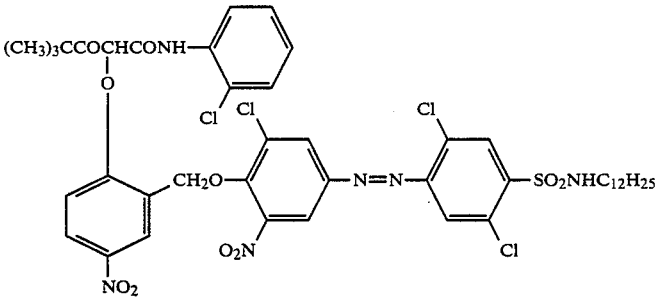
Y-9
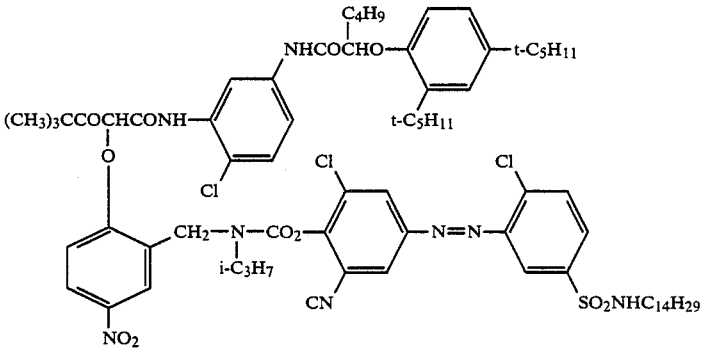

-continued
Y-10
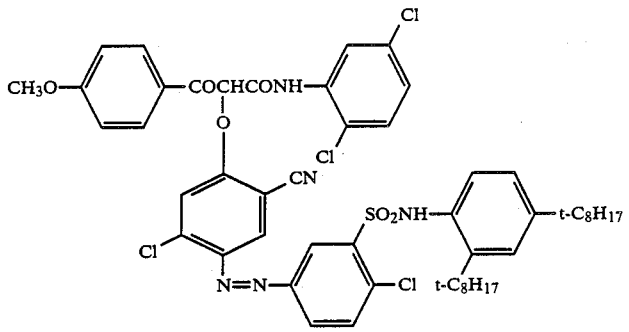
Y-11
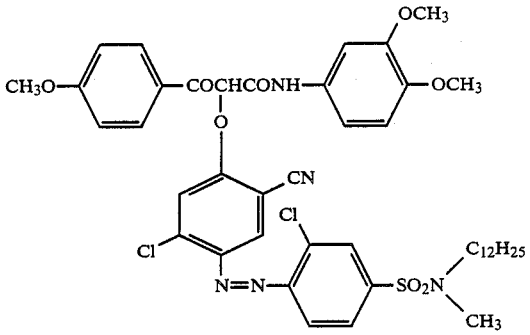
Y-12
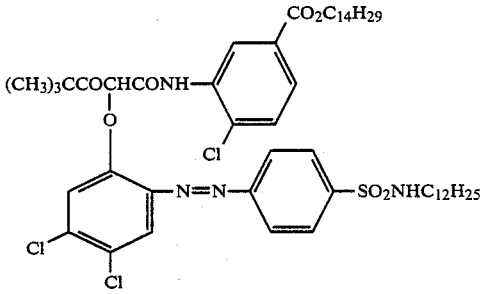
Y-13
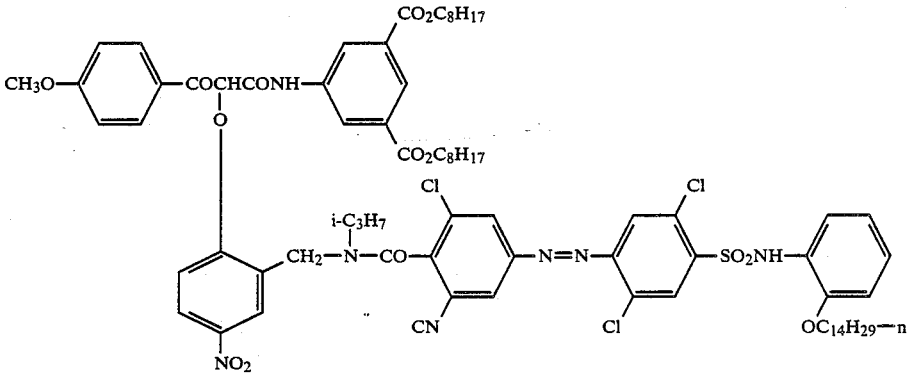

-continued
Y-14
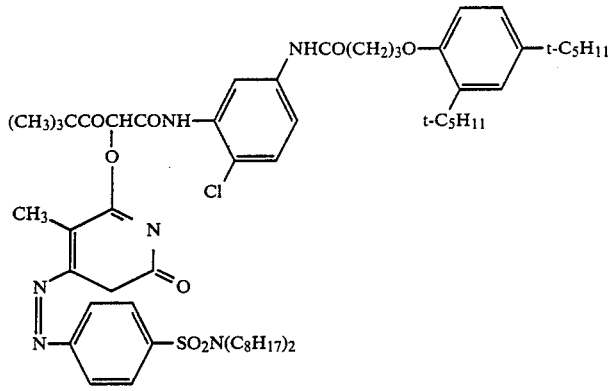
Y-15
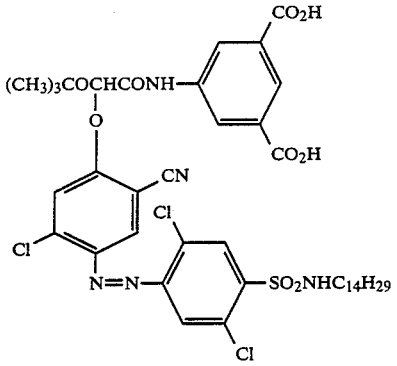
Y-16
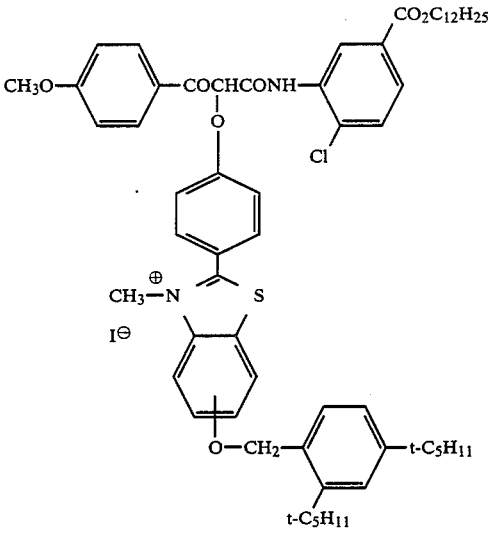
Y-17
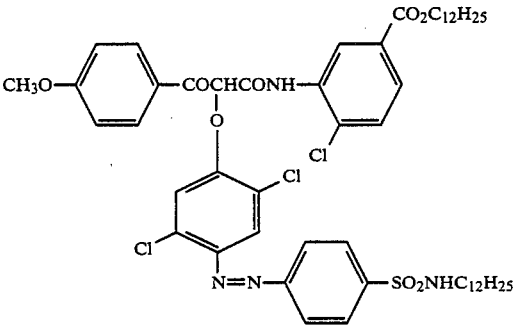

-continued
Y-18
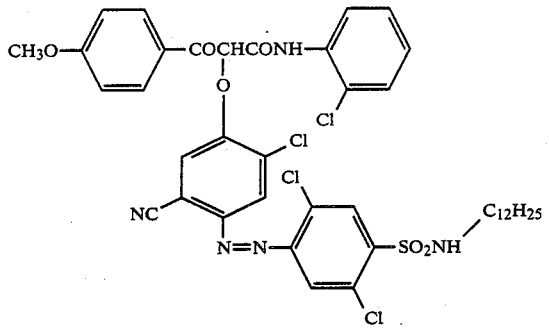
Y-19
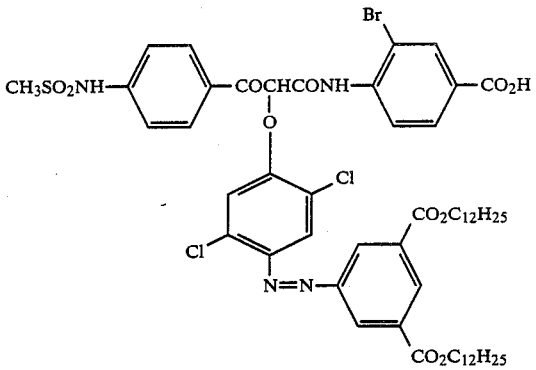
Examples of couplers recovering a magenta dye as a result of cleavage between TIME (when n≧1) or Cp (when n=0) and X are as follows.
M-1
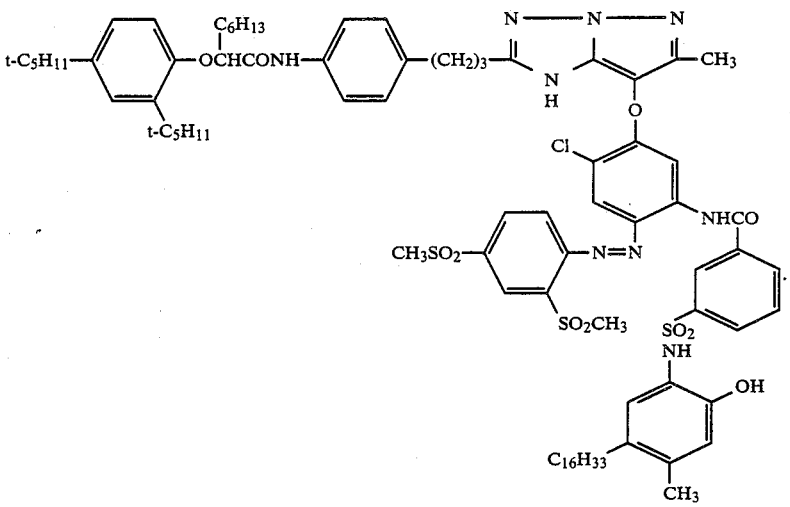
M-2
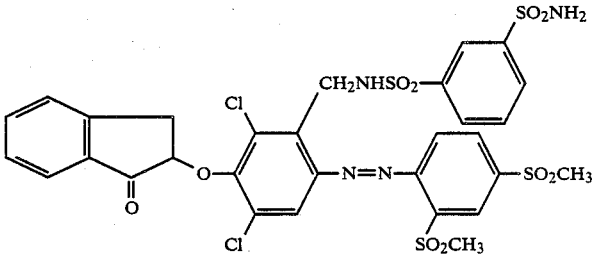

-continued
M-3
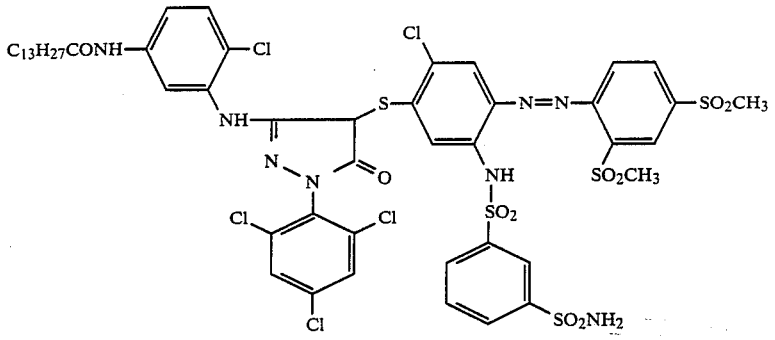
M-4
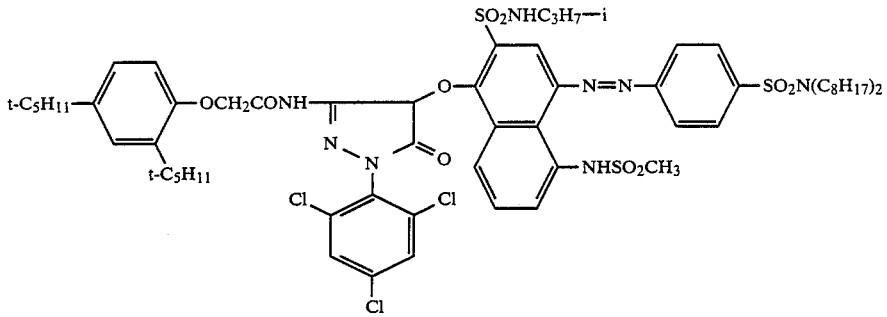
M-5
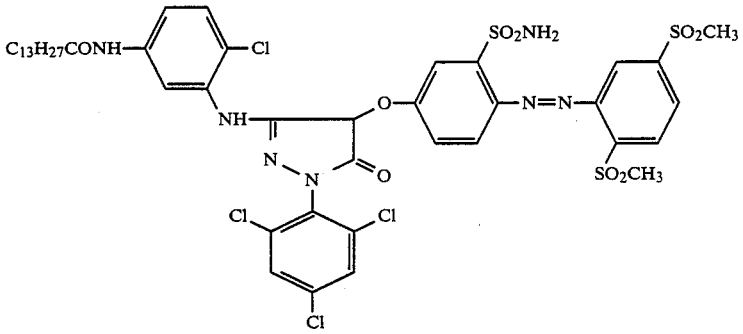
M-6
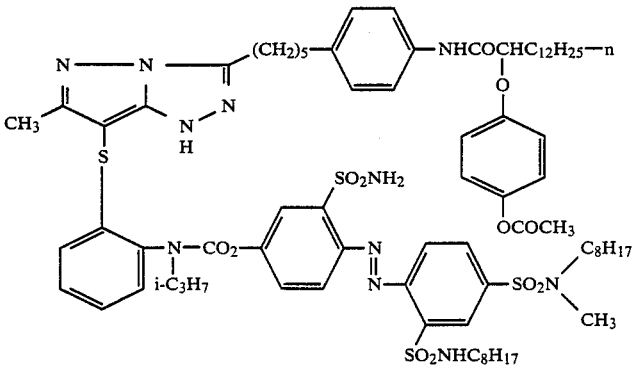

-continued
M-7
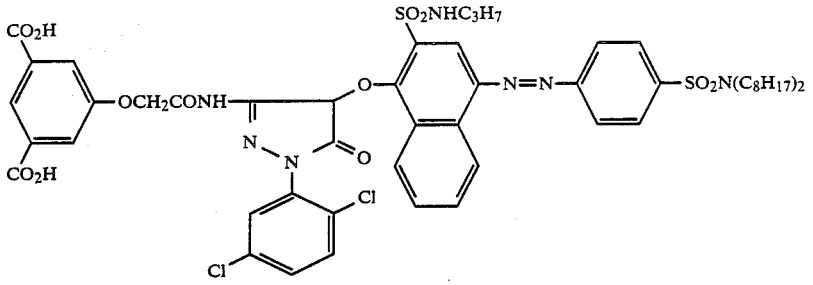
Examples of couplers recovering a cyan dye as a result of cleavage between TIME (when n≧1) or Cp (when n=0) and X are as follows.
C-1
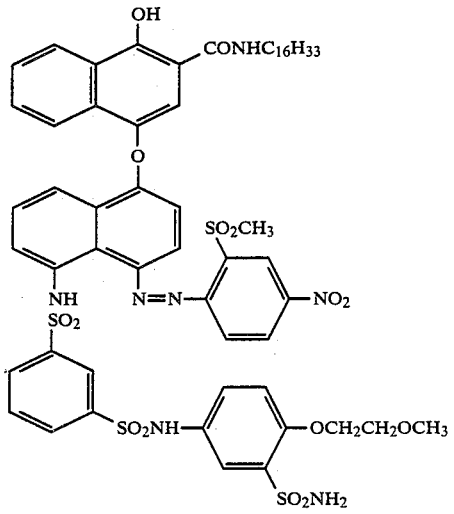
C-2
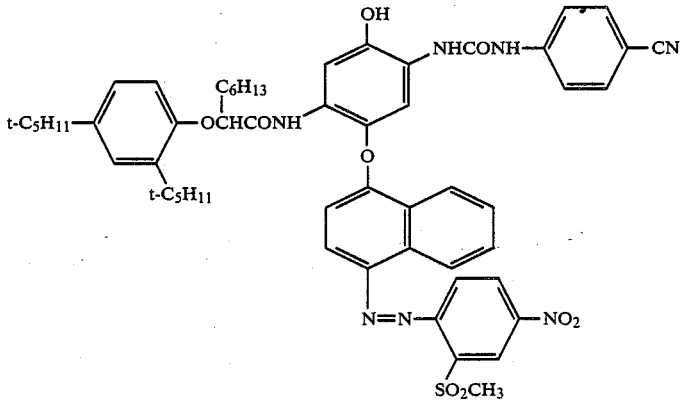

-continued
C-3
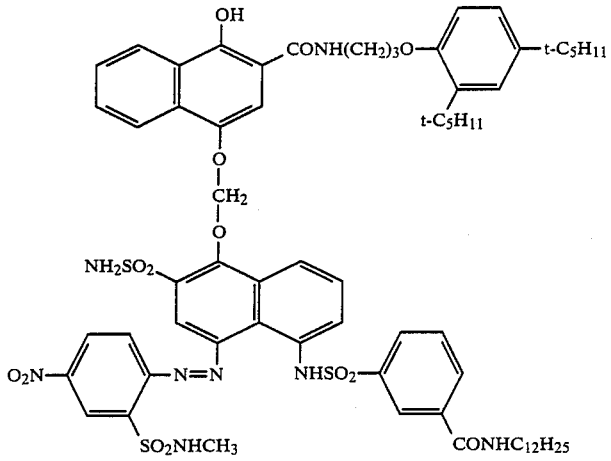
C-4
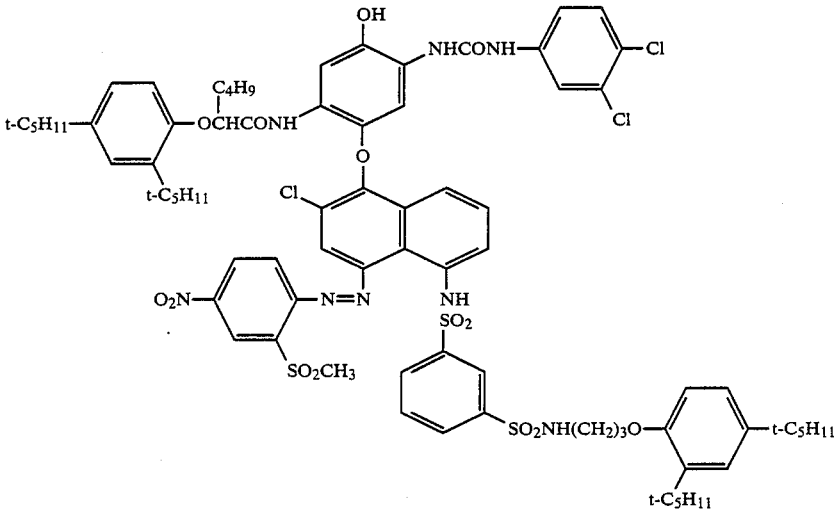
C-5
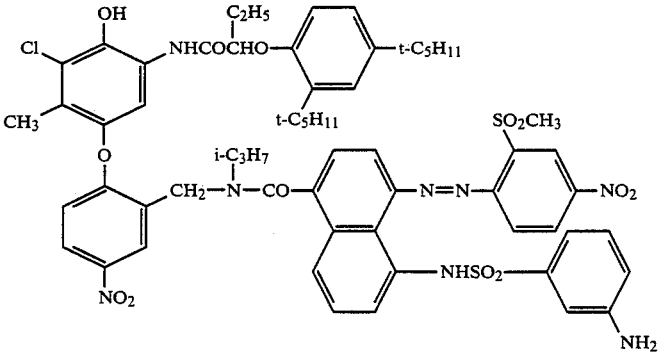

-continued

C-6

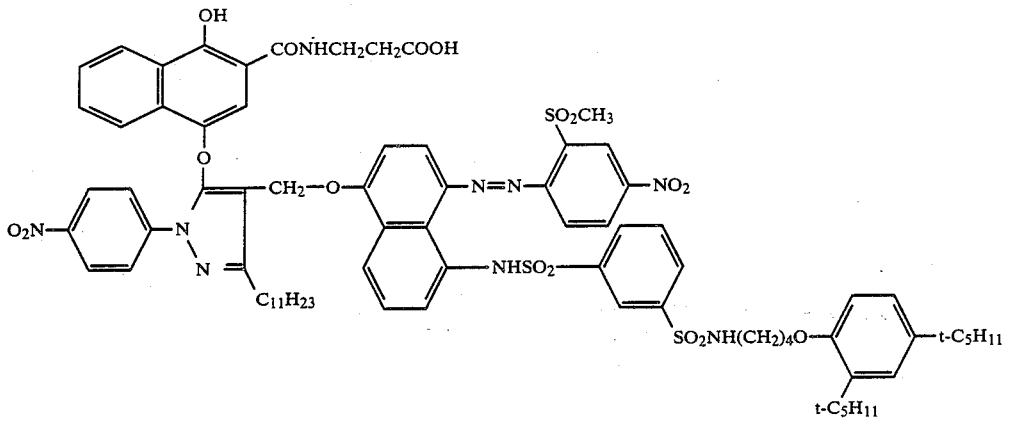

C-7

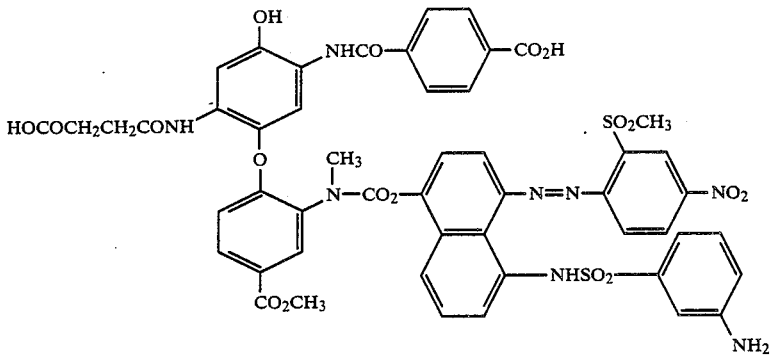

The compounds of the present invention can be synthesized according to the process disclosed in U.S. Ser. No. 769,903 or Synthesis Examples given below.

SYNTHESIS EXAMPLE 1

Synthesis of Compound Y-2

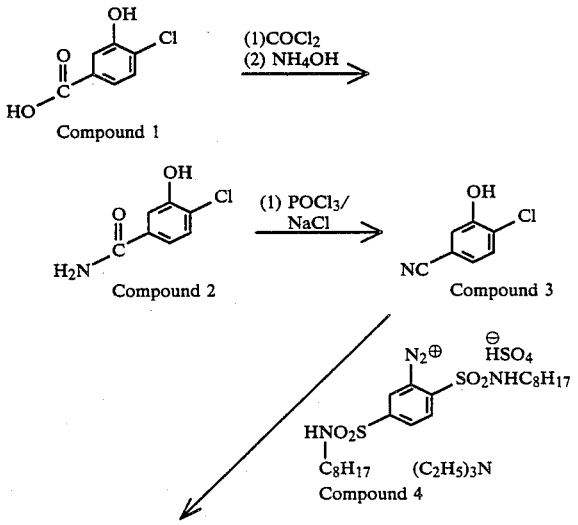

-continued

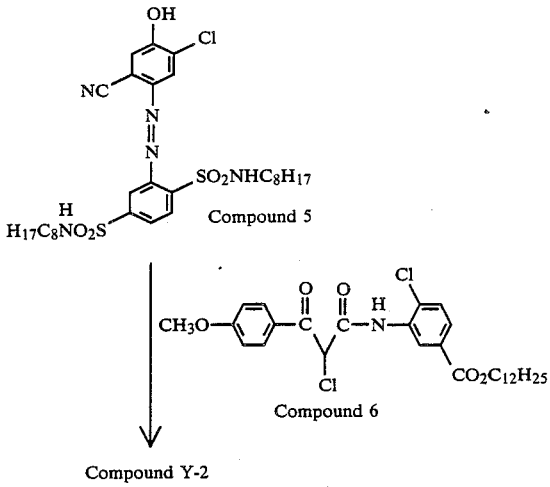

(1) Synthesis of Compound 3:

Thirty-two grams (0.2 mol) of Compound 1 and 200 ml of thionyl chloride were mixed, and the mixture was heated at reflux for 3 hours. The excess thionyl chloride was removed by distillation under reduced pressure, and the residual oil was dissolved in 200 ml of tetrahydrofuran. Ammonia gas was blown to the solution under refluxing under a period of 1 hour. After the excess ammonia and the tetrahydrofuran were removed by distillation under reduced pressure, diluted hydrochloric acid was added to the residue. The aqueous layer was repeatedly extracted with ethyl acetate. The organic layer was dried, and the solvent was removed therefrom by distillation under reduced pressure to obtain 27 g of crude crystals of Compound 2. The crude crystals (27 g) mainly comprising Compound 2 were suspended as such in 200 ml of benzene, and 76 g (0.5 mol) of phosphoryl chloride and 11.6 g (0.2 mol) of sodium chloride were added thereto. The mixture was heated at reflux for 4 hours. After cooling, the reaction mixture was washed with water, and the organic layer was concentrated to obtain 24 g of Compound 3 as a crystal having a low melting point. This product was subjected to the next reaction without purification.

(2) Synthesis of Compound 5:

In 200 ml of methyl cellosolve were dissolved 14.1 g (0.1 mol) of Compound 3 and 50 g (0.5 mol) of triethylamine, and the resulting solution was kept at 5° C. To the solution was slowly added dropwise 400 ml of a solution of 58.4 g (0.1 mol) of Compound 4 (easily obtainable by using 47.5 g of the corresponding anilino compound, 6.9 g of sodium nitrite and 20 ml of sulfuric acid in water-containing methyl cellosolve at 10° C.) in a mixed solvent of methyl cellosolve/water (4:1 by volume). After the dropwise addition, the mixture was stirred for 1 hour while maintaining at 10° C. or less. One liter of water was added to the reaction mixture, and the mixture was adjusted to a pH of 3 with diluted hydrochloric acid. The reaction mixture was repeatedly extracted with ethyl acetate, and the organic layer was dried and distilled off under reduced pressure. The residue was crystallized from water/ethanol and recrystallized from the same mixed solvent to obtain 37.5 g of Compound 5 as a red crystal.

(3) Synthesis of Compound Y-2:

In 150 ml of acetonitrile were dissolved 6.3 g (0.01 mol) of Compound 5 and 5.5 g (0.01 mol) of Compound 6, and 1.0 g (0.01 mol) of triethylamine was added thereto, followed by heat-refluxing for 2 hours. After coolling, the solvent was removed by concentration under reduced pressure, and water was added to the residue to effect crystallization. Recrystallization of the crude crystals from ethyl acetate/hexane gave 8.1 g of Compound Y-2 as a light yellow crystal.

SYNTHESIS EXAMPLE 2

Synthesis of Compound Y-9

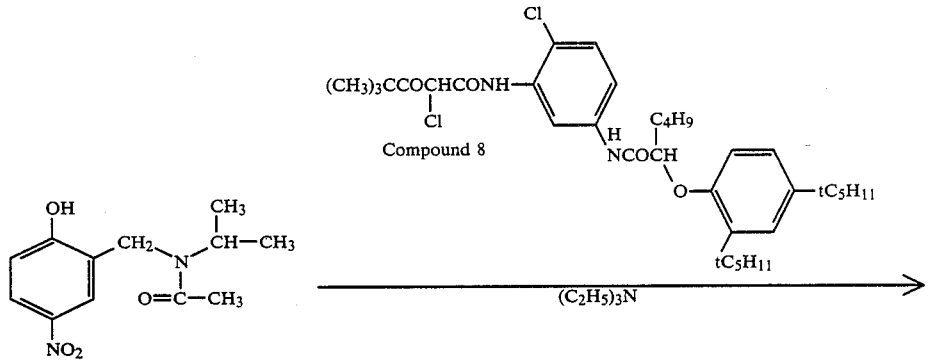

Compound 7

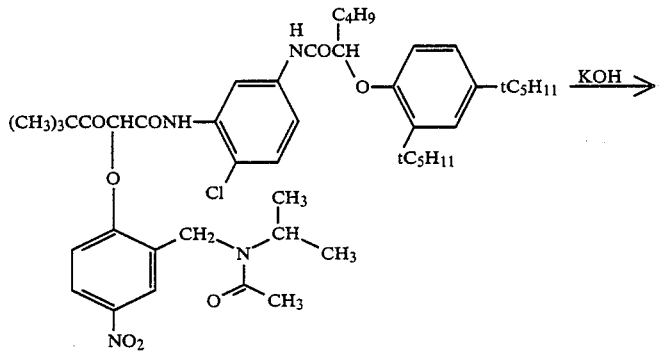

Compound 9

-continued

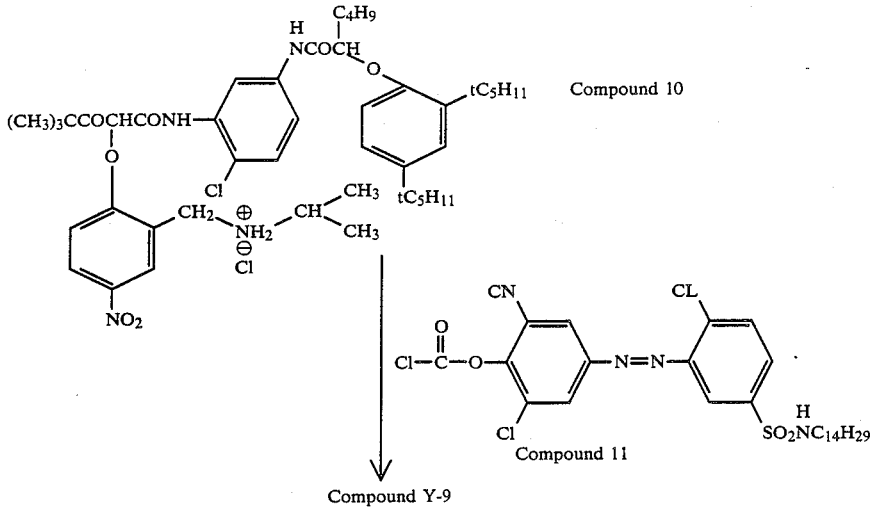

(1) Synthesis of Compound 9:

In 300 ml of acetonitrile were dissolved 25.2 g of Compound 7 and 59.7 g of Compound 8, and 11 g of triethylamine was added thereto, followed by refluxing for 3 hours. The reaction mixture was poured into diluted hydrochloric acid, and the mixture was repeatedly extracted with ethyl acetate. The organic layer was washed with water, dried and distilled under reduced pressure to remove the solvent. The resulting oily product weighing 81.5 g was separated and purified by column chromatography (eluent: ethyl acetate/hexane=1:2 by volume) to obtain 49.2 g of Compound 9 as a yellow crystal.

(2) Synthesis of Compound 10:

In 300 ml of water-containing ethyl alcohol ($C_2H_5OH:H_2O=5:1$ by volume) was dissolved 9.9 of potassium hydroxide, and 40.5 g of Compound 9 was added thereto, followed by heating at reflux for 3 hours. After cooling, concentrated hydrochloric acid was added to the reaction mixture, and the mixture was repeatedly extracted with chloroform. The organic layer was washed with water, dried and distilled under reduced pressure to remove the solvent to obtain 37.4 g of a crude crystal. Recrystallization from chloroform-hexane yielded 29.5 g of Compound 10 as a yellow crystal.

(3) Synthesis of Compound Y-9:

Eight grams of triethylamine were added to 200 ml of a tetrahydrofuran solution containing 17.0 g of Compound 10, followed by stirring for 20 minutes. To the mixture was added 12.6 g of Compound 11 (easily obtainable from a sodium salt of the corresponding phenol compound and trichloromethyl chloroformate in tetrahydrofuran), followed by stirring at room temperature for 4 hours. The reaction mixture was concentrated under reduced pressure, and to the residue was added diluted hydrochloric acid. The mixture was repeatedly extracted with ethyl acetate. The organic layer was washed with water, dried and distilled to remove the solvent to obtain 23.7 g of crude crystals. The resulting crude crystals were separated and purified by column chromatography (eluent: hexane/ethyl acetate=1:1 by volume) to give 14.3 of Compound Y-9 as a yellow crystal. The structure of this product was confirmed by the NMR stpectrum.

SYNTHESIS EXAMPLE 3

Synthesis of Compound M-4

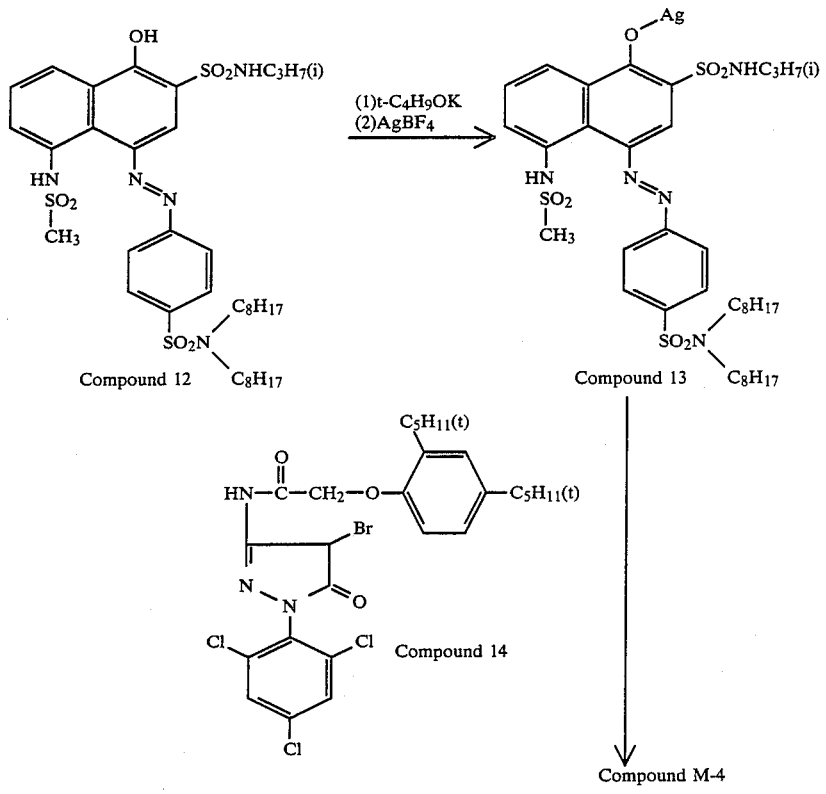

In 100 ml of acetonitrile was dissolved 15.3 g (0.02 mol) of Compound 12, and 2.24 g (0.02 mol) of potassium t-butoxide was added thereto. After stirring at room temperature for 30 minutes, 3.9 g (0.02 mol) of silver tetrafluoroborate ($AgBF_4$) was added thereto, and the mixture was stirred at 40° C. for 20 minutes in a nitrogen atmosphere while shielding light to thereby obtain Compound 13. To the reaction mixture containing Compound 13 was added 100 ml of an acetonitrile solution of 12.6 g (0.02 mol) of Compound 14, and the resulting mixture was heated at reflux for 1 hour. After cooling, the reaction mixture was filtered under reduced pressure to remove any insoluble matters (salts), and the mother liquor was concentrated. Diluted hydrochloric acid was added to the concentrate, and the aqueous layer was repeatedly extracted with ethyl acetate. The extract was washed with a saturated sodium chloride aqueous solution, and the organic layer was dried over sodium sulfate. Concentration of the organic layer gave 26 g of crude crystals. The crude crystals were recrystallized twice from ethyl acetate/hexane (1:1 by volume) to obtain 16.4 g of Compound M-4 as a light red crystal.

Compounds releasing a development inhibitor or a precursor thereof upon the reaction with an oxidized product of an aromatic primary amine developer (which are herein abbreviated to "DIR compounds") are represented by formulae (XVI) to (XVIII).

A—TIME—Z (XVI)

A—Z (XVII)

B—Z (XVIII)

In the above formulae, A represents a coupling component capable of reacting with an oxidized product of a color developing agent, and of releasing a group —TIME—Z upon reaction with the oxidized product of the color developing agent, B represents a redox portion releasing Z upon the oxidation-reduction reaction with the oxidized color developing agent followed by alkali hydrolysis, TIME represents a timing group, and Z represents a development inhibitor group.

Examples of preferable timing groups represented by TIME in formula (XVI) are the same as those for formula (I) disclosed hereinabove.

The development inhibitor groups represented by Z includes groups derived from development inhibitors as described in Research Disclosure, Vol. 176, RD No. 17643 (December, 1978). Preferred examples are mercaptotetrazole, selenotetrazole, mercaptobenzothiazole, selenobenzothiazole, mercaptobenzooxazole, selenobenzooxazole, mercaptobenzimidazole, selenobenzimidazole, benzotriazole, mercaptotriazole, mercaptooxadiazole, mercaptothiadiazole, and their derivatives.

Preferred are the development inhibitor groups represented by the following formulae.

[Z-1]

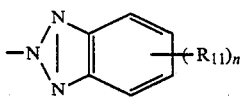

-continued

[Z-2]

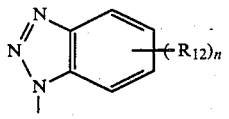

[Z-3]

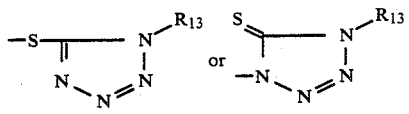

[Z-4]

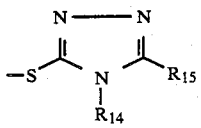

[Z-7]

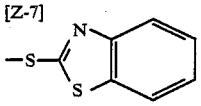

[Z-5]

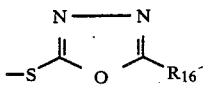

[Z-8]

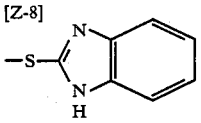

[Z-6]

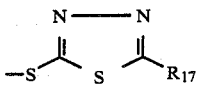

[Z-9]

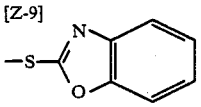

In the formulae (Z-1) and (Z-2), $R_{11}$ and $R_{12}$ are each an alkyl group, an alkoxyl group, an acylamino group, a halogen atom, an alkoxycarbonyl group, a thiazolideneamino group, an aryloxycarbonyl group, an acyloxy group, a carbamoyl group, an N-alkylcarbamoyl group, an N,N-dialkyl carbamoyl group, a nitro group, an amino group, an N-arylcarbamoyloxy group, a sulfamoyl group, a sulfonamide group, an N-alkylcarbamoyloxy group, a ureido group, a hydroxyl group, an alkoxycarbonylamino group, an aryloxy group, an alkylthio group, an arylthio group, an anilino group, an aryl group, an azolideneimino group, a heterocyclic group, a cyano group, an alkylsulfonyl group, or an aryloxycarbonyl group.

n is 1 or 2; when n is 2, $R_{11}$ and $R_{12}$ may be the same or different, and the total number of carbon atoms of $(R_{11})n$ and $(R_{12})n$ is from 0 to 20, and preferably is from 7 to 20.

In formulae (Z-3), (Z-4), (Z-5), and (Z-6), $R_{13}$, $R_{14}$, $R_{15}$, $R_{16}$ and $R_{17}$ each represents an alkyl group, an aryl group, or a heterocyclic group.

When $R_{11}$–$R_{17}$ represent an alkyl groups, they may be substituted or unsubstituted, and chain-like or cyclic. Examples of such substituents are a halogen atom, a nitro group, a cyano group, an aryl group, an alkoxyl group, an aryloxy group, an alkoxycarbonyl group, an aryloxycarbonyl group, a sulfamoyl group, a carbamoyl group, a hydroxyl group, an alkanesulfonyl group, an arylsulfonyl group, an alkylthio group, and an arylthio group.

When $R_{11}$–$R_{17}$ represent an aryl group, they may be substituted. Examples of such substituents are an alkyl group, an alkenyl group, an alkoxy group, an alkoxycarbonyl group, a halogen atom, a nitro group, an amino group, a sulfamoyl group, a hydroxyl group, a carbamoyl group, an aryloxycarbonylamino group, an alkoxycarbonylamino group, an acylamino group, a cyano group, and a ureido group.

When $R_{11}$–$R_{17}$ represent a heterocyclic group, they are a 5- or 6-membered monocyclic or condensed ring containing at least one of hetero atoms such as a nitrogen atom, an oxygen atom and a sulfur atom. Examples of such heterocyclic groups are a pyridyl group, a quinolyl group, a furyl group, a benzothiazolyl group, an oxazolyl group, an imidazolyl group, a thiazolyl group, a triazolyl group, a benzotriazolyl group, an azolideneimino group, and an oxadine group. This heterocyclic group may be substituted with a group or groups as listed for the above aryl group.

In formulae (Z-3), (Z-4), (Z-5), and (Z-6), the total number of carbon atoms contained in $R_{13}$ to $R_{17}$ is generally at most 20, and preferably 2 to 20.

The component A in formulae (XVI) and (XVII) has the same meaning as do the components Cp (III) to (XIII) of formula (I).

Formula (XVIII) represents a compound releasing a development inhibitor or its precursor upon undergoing an oxidation-reduction reaction with an oxidized product of an aromatic primary amine developing agent and subsequently alkali hydrolysis (which compound is hereinafter referred to as a "DIR redox command"). B represents a redox portion. More in detail, it is represented by formula (XIX).

(XIX)

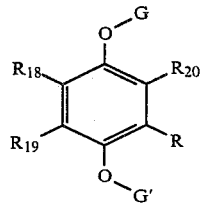

In formula (XIX), G and G' each represents a hydrogen atom or a protective group for a phenolic hydroxyl group, said protective group capable of being removed during the photogrpahic processing. Typical examples are a hydrogen atom, an acyl group, a sulfonyl group, an alkoxycarbonyl group, a carbamoyl group, and an oxalo group. $R_{18}$, $R_{19}$, and $R_{20}$ may be the same or different and are each a hydrogen atom, a halogen atom, an alkyl group, an aryl group, an alkoxyl group, an aryloxy group, an alkylthio group, an arylthio group, a cyano group, an alkoxycarbonyl group, a carbamoyl group, a sulfamoyl group, a carboxyl group, a sulfo group, a sulfonyl group, an acyl group, a carbonamido group, a sulfonamido group, or a heterocyclic group.

$R_{18}$ and $R_{19}$, $R_{18}$ and G, $R_{19}$ and G', and $R_{20}$ and G combine together to form an aromatic or non-aromatic ring. At least one of $R_{18}$, $R_{19}$, and $R_{20}$ contains an anti-diffusing group having from 10 to 20 carbon atoms.

Z is a development inhibitor as above.

Preferred as the development inhibitors of the present invention are compounds exhibiting high absorptivity onto silver halide and having a high development inhibiting ability. More preferred are compounds which release a development inhibitor upon reaction with an oxidized product of a developing agent, said development inhibitor being capable of exhibiting a development inhibiting effect in the same layer as that in which it is contained at the time of development.

These compounds can be easily synthesized by the methods described in U.S. Pat. Nos. 3,227,554, 3,617,291, 3,933,500, 3,958,993, 4,149,886, 4,234,678, Japanese patent application (OPI) Nos. 13239/76 (corresponding to British Pat. No. 1,488,080), 56837/82, British Pat. Nos. 2,070,266, 2,072,363, *Research Disclosure,* RD No. 21228 (December, 1981), Japanese patent publication Nos. 9942/83, 16141/76 (corresponding to U.S. Pat. Nos. 4,095,984 and 3,958,993, respectively), Japanese patent application (OPI) Nos. 90932/77 (corresponding to U.S. Pat. No. 4,146.396), U.S. Pat. No. 4,248,962, Japanese patent application (OPI) Nos. 114946/81, 154234/82 (corresponding to U.S. Pat. No. 4,409,323 and RD 21228, respectively), 98728/83, 209736/83, 209737/83, 209738/83, 209740/83, and Japanese patent application No. 278853/84.

Representative examples of the DIR compounds used in accordance with the present invention are shown below, although the present invention is not limited thereto.

T-101

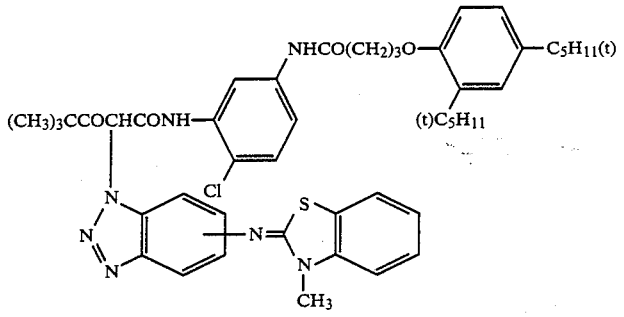

T-102

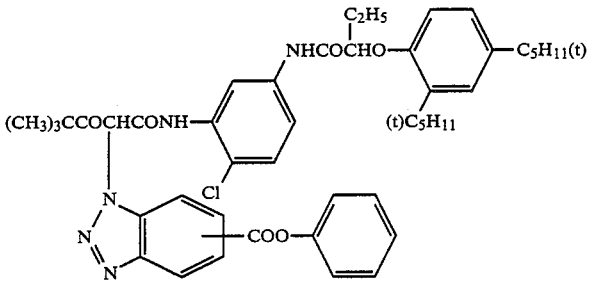

T-103

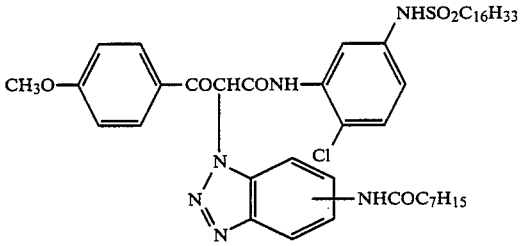

T-104

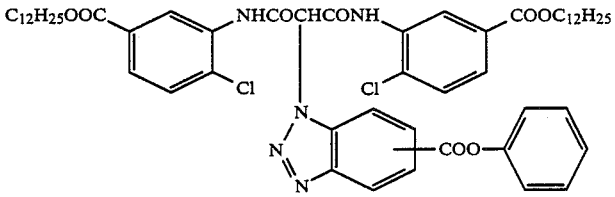

T-105

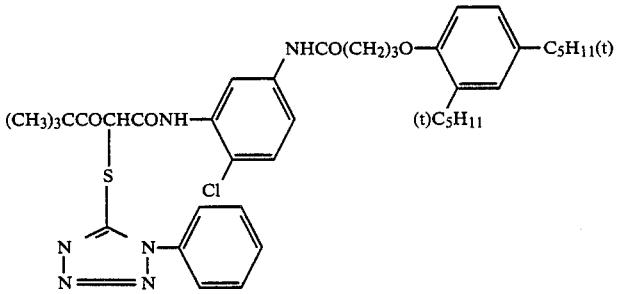

-continued
T-106
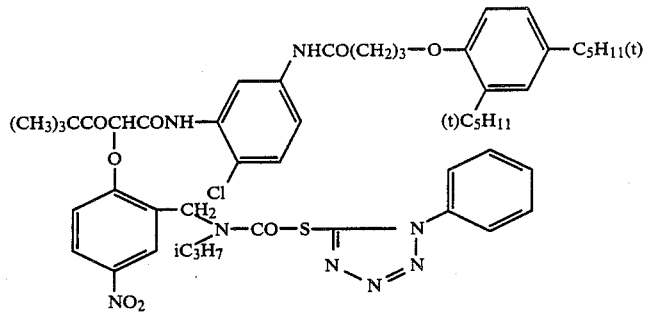
T-107
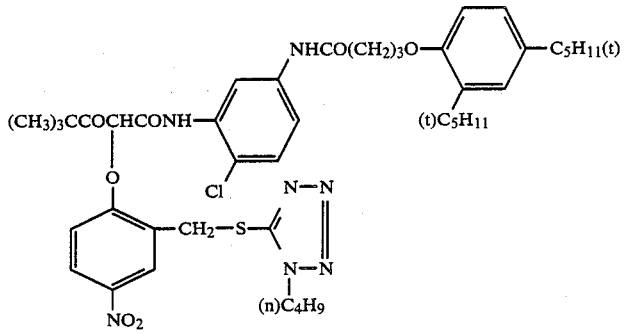
T-108
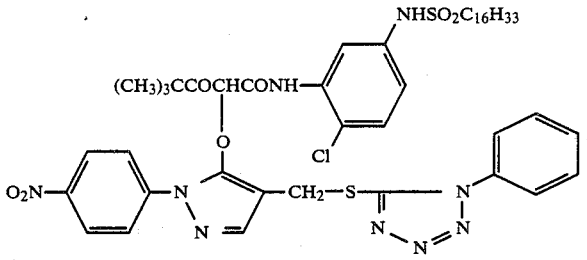
T-109
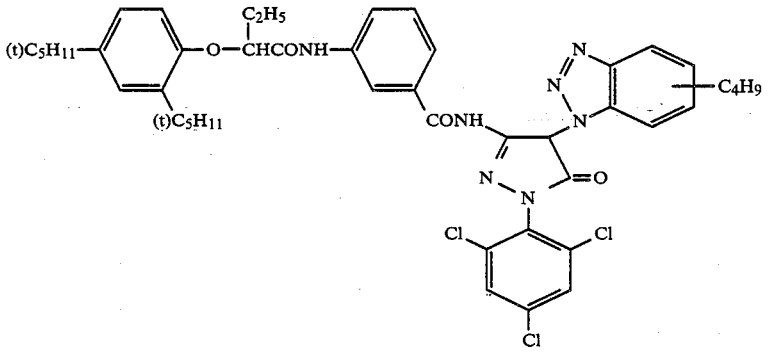

-continued
T-110
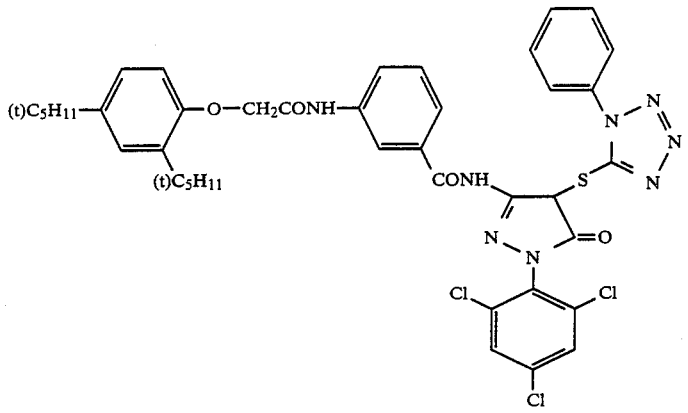
T-111
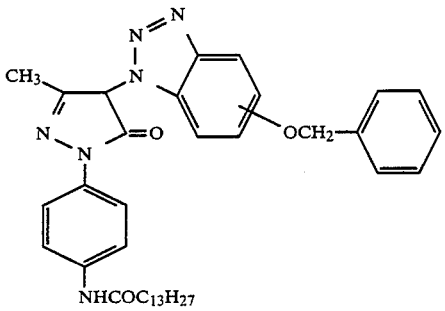
T-112
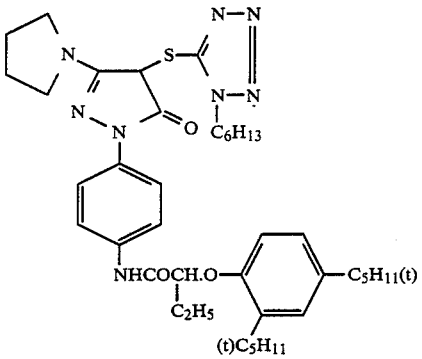
T-113
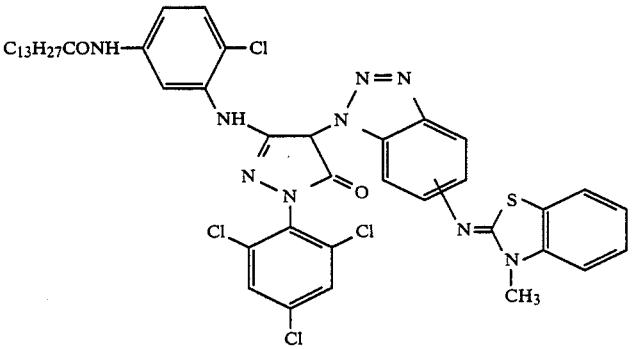

-continued
T-114
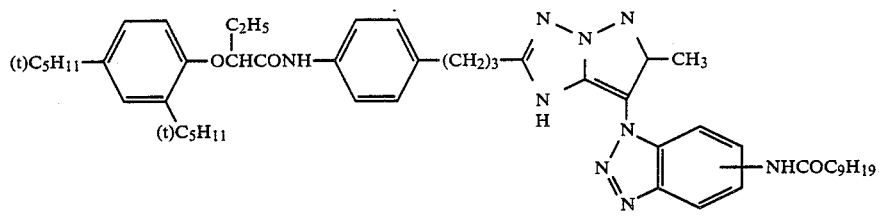
T-115
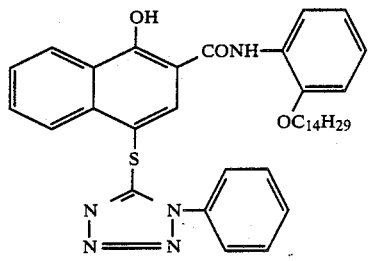
T-116
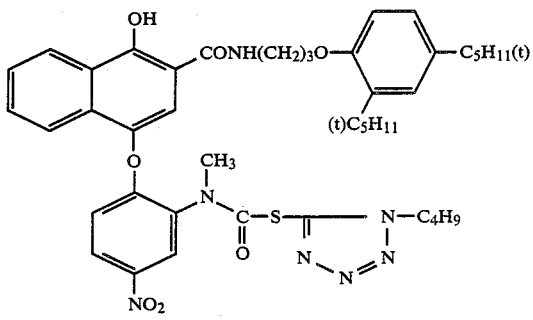
T-117
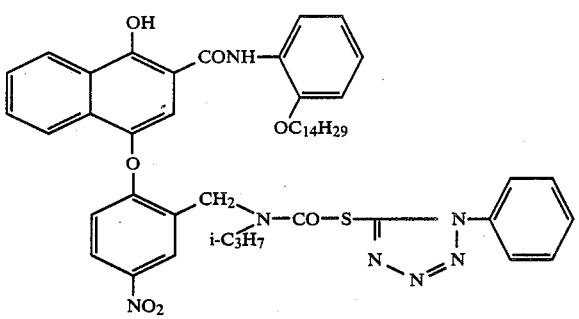
T-118
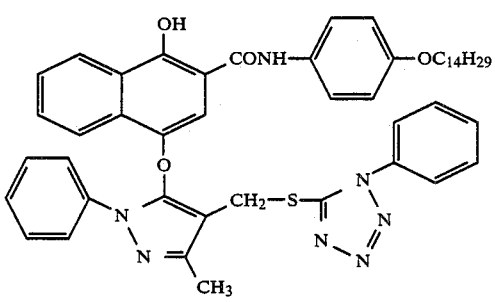

-continued
T-119
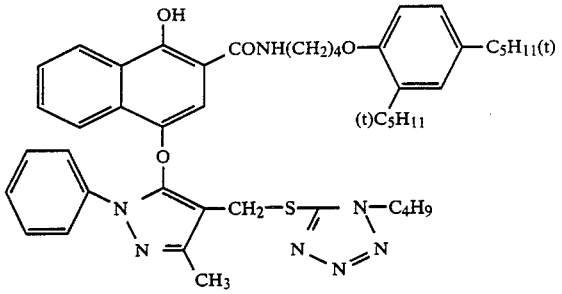
T-120
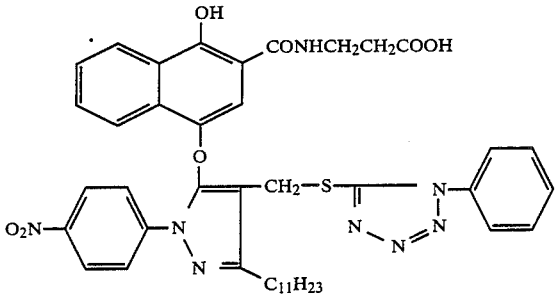
T-121
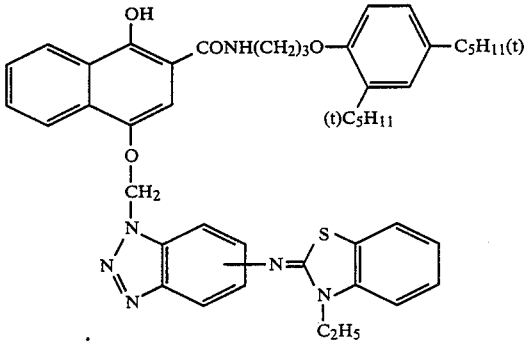
T-122
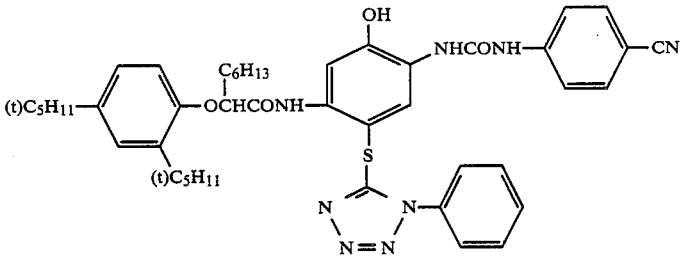
T-123
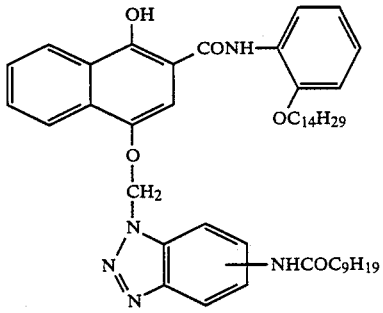

-continued
T-124
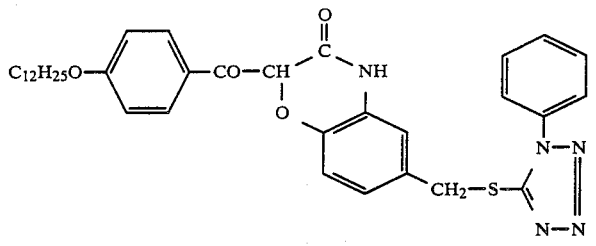
T-125
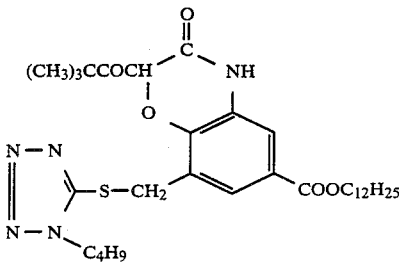
T-126
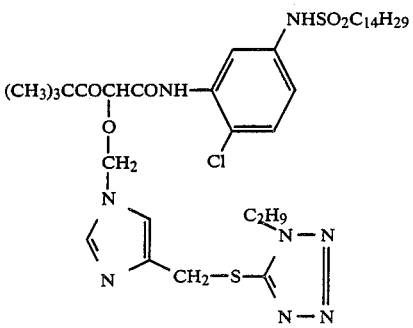
T-127
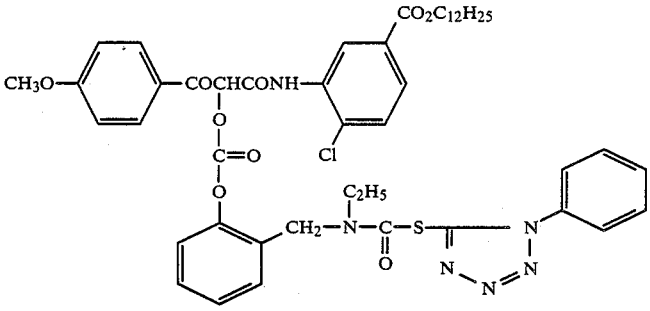
T-128
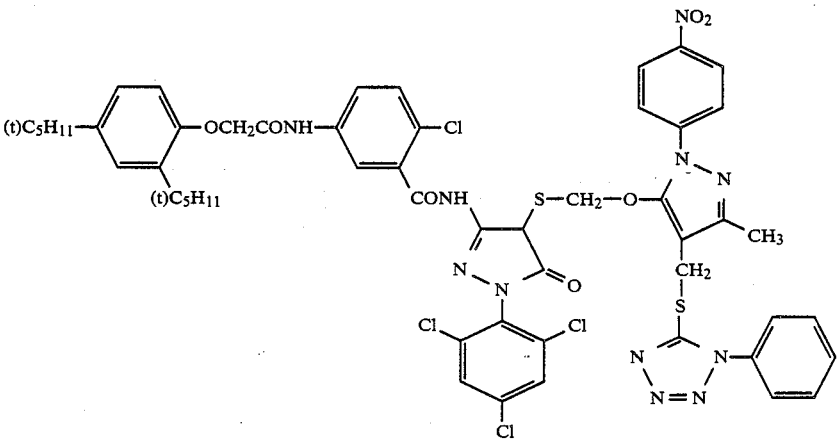

-continued
T-129
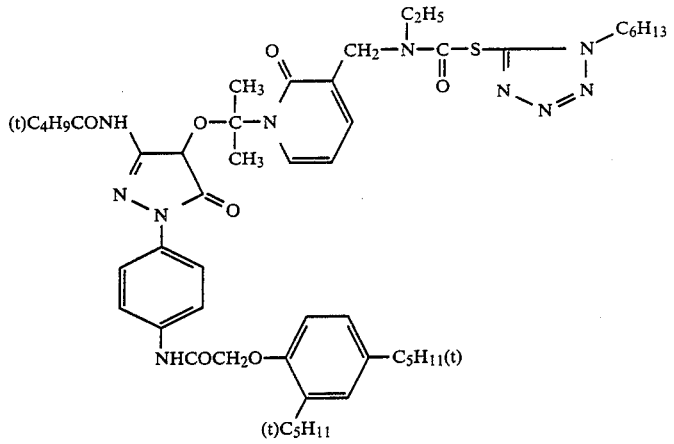
T-130
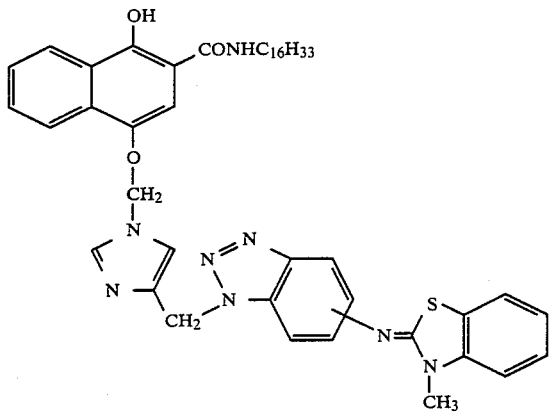
T-131
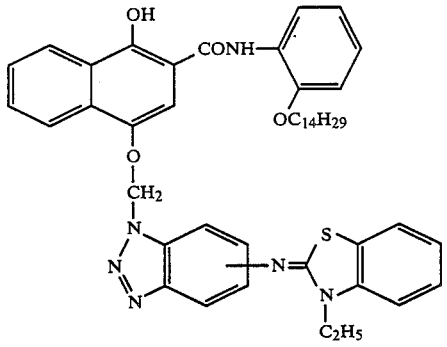
T-132
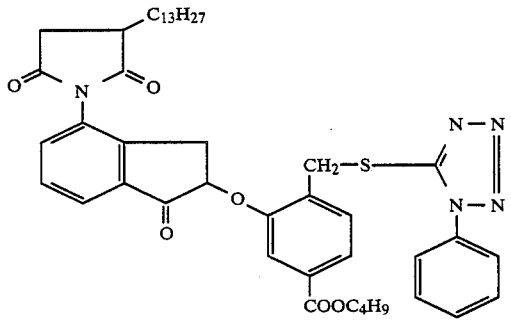

-continued
T-133
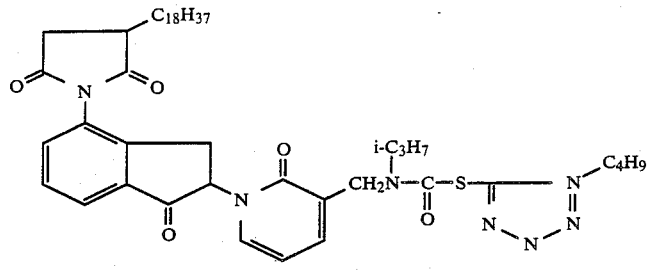
T-134
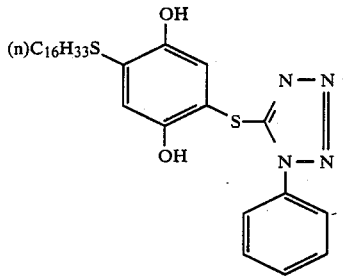
T-135
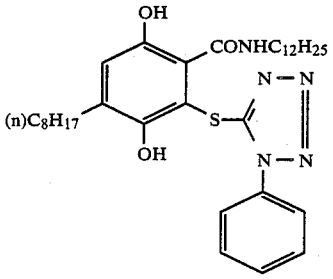
T-136
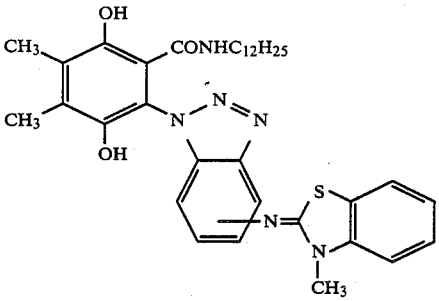
T-137
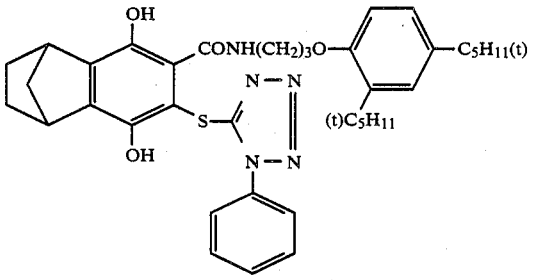

-continued

T-138

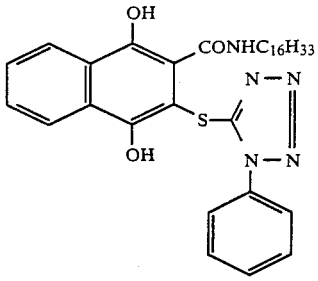

T-139

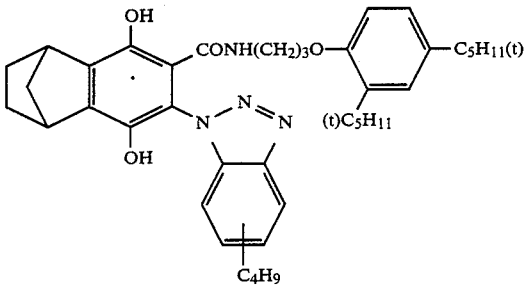

T-140

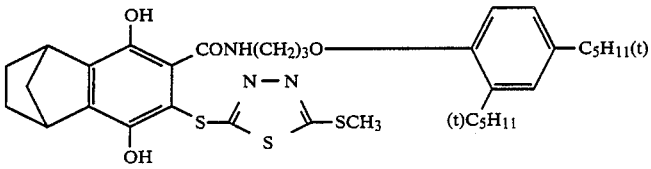

When the coupler newly forming a dye of the present invention is used in a silver halide photographic light-sensitive material, it may be incorporated in a light-sensitive layer group or a non-light-sensitive layer group on a support. Usually, when either a dye formed by a coupling reaction of the coupler moiety of the coupler of the present invention with an oxidized product of a developing agent, or a new dye formed at the time of the reaction is a yellow dye, it is incorporated in a blue-sensitive emulsion layer; when either the dye or the new dye is a magenta dye, it is incorporated in a green-sensitive emulsion layer; and when either the dye or the new dye is a cyan dye, it is incorporated in a red-sensitive emulsion layer. Of course, the present invention is not limited to the above combination, and other combinations can be employed.

The dye-releasing coupler of the present invention is used in an amount of from 0.005 to 2 g/m$^2$, and preferably from 0.01 to 1 g/m$^2$.

When the DIR compound of the present invention is used, it can be incorporated in at least one layer of a light-sensitive layer group and a non-light-sensitive layer group on the support. The DIR compound can be used in the same color-sensitive layer as the coupler of the present invention, or a plurality of light-sensitive layer or non-light-sensitive layers of the same color-sensitive layer group, or a non-light-sensitive layer adjacent to a layer containing the coupler of the present invention in combination with the coupler of the present invention. Preferably the DIR compound is used in the same layer in combination with the coupler of the present invention.

The amount of the DIR compound used according to the present invention is, when the DIR compound is added to the same layer as that to which the coupler of the present invention is added and/or an adjacent layer, generally from 0.001 to 1 mol, and preferably from 0.005 to 0.3 mol per mol of the coupler used according to the present invention. In other cases, that is, particularly when the DIR compound is added to layers other than the same layer as that in which the coupler of the present invention is present, and/or an adjacent layer, the amount of the DIR compound coated is generally from 0.005 to 1 g/m$^2$, and preferably from 0.01 to 0.5 g/m$^2$.

The silver halide photographic light-sensitive material of the present invention may be a monochromatic color photographic light-sensitive material comprising a support and one light-sensitive silver halide emulsion layer on the support, or a multi-layer color photographic light-sensitive material comprising a support and at least two layers having different spectral sensitivities.

The present invention can be applied to a photographic light-sensitive material of the type, wherein, in addition to the dye formed from the coupler of the present invention, developed silver is also utilized as an image.

The multi-layer color photographic material usually carries at least one red-sensitive emulsion layer, at least one green-sensitive emulsion layer, and at least one blue-sensitive emulsion layer on a support. The order in which these layers are provided on the support can be determined appropriately depending on the intended purposes. Usually the red-sensitive emulsion layer contains a cyan-forming coupler, the green-sensitive emulsion layer contains a magenta-forming coupler, and the blue-sensitive emulsion layer contains a yellow-forming coupler. In some cases, other combinations can be employed.

In the same or different photographic emulsion layer, or non-light-sensitive layer of the photographic light-sensitive material according to the present invention, in combination with the couplers of formula (I), other couplers, i.e., compounds capable of forming color upon oxidative coupling with an aromatic primary amine developer (e.g., phenylenediamine derivatives and aminophenol derivatives) in the color development processing may be used.

When these couplers are used in combination with the couplers of the present invention in the same color-sensitive layer or layer group, the amount of the couplers used is generally from 0.01 to 20 mol, and preferably from 0.01 to 10 mols, per mol of the coupler of the present ivnention.

In the silver halide multi-layer color photographic light-sensitive material of the present invention, yellow, magenta, and cyan color-forming couplers are usually used. For all three colors, the couplers of the present invention can be used. If desired, however, the coupler of the present invention can be partly replaced with conventionally known couplers.

Useful couplers include cyan, magenta, and yellow color-forming couplers. Typical examples are naphthol or phenol-based compounds, pyrazoles or pyrazoloazole-based compounds, and open chain or heterocyclic ketomethylene compounds. Representative examples of these cyan, magenta, and yellow couplers that can be used in the present invention are described in *Research Disclosure,* RD No. 17643 (December 1978), Paragraph VII-D and ibid. RD No. 18717 (November 1979).

It is preferred for the coupler contained in the light-sensitive material to be anti-diffusing, by having a ballast group or by being polymerized. Two-equivalent couplers substituted with a releasing group in the coupling active site decrease the amount of silver coated and provide high sensitivity as compared with 4-equivalent couplers having a hydrogen atom in the coupling active site. In addition, couplers providing a colored dye having suitable diffusability, colorless couplers, and couplers releasing a development accelerator can be used.

A typical example of the yellow coupler which can be used in the present invention is an oil-protect-type acylacetamide-based coupler. Representative examples are described in U.S. Pat. Nos. 2,407,210, 2,875,057 and 3,265,506. Typical examples of the 2-equivalent yellow coupler are oxygen atom releasing type yellow couplers as described in U.S. Pat. Nos. 3,408,194, 3,447,928, 3,933,501 and 4,022,620, and nitrogen atom releasing type yellow couplers as described in Japanese patent publication No. 10739/83, U.S. Pat. Nos. 4,401,752, 4,326,024, RD 18053 (April 1979), British Pat. No. 1,425,020, West German patent application Laid-Open Nos. 2,219,917, 2,261,361, 2,329,587 and 2,433,812. α-Pivaloylacetoanilide-based couplers are excellent in fastness, especially light fastness of colored dye. On the other hand, α-benzoylacetoanilide-based couplers provide a high color density.

Magenta couplers which can be used in the present invention include oil protect-type indazolone-, cyanoacetyl-, preferably 5-pyrazole- and pyrazoloazole-based (e.g., pyrazolotriazoles) couplers. 5-Pyrazolone-based couplers which are substituted with an arylamino group or an acylamino group in the 3-position are preferred from viewpoints of hue of colored dye and color density. Typical examples are described in U.S. Pat. Nos. 2,311,082, 2,343,703, 2,600,788, 2,908,573, 3,062,653, 3,152,896, and 3,936,015. As the releasing group of the 2-equivalent 5-pyrazolone-based coupler, a nitrogen atom releasing group as described in U.S. Pat. No. 4,310,619 or an arylthio group as described in U.S. Pat. No. 4,351,897 is particularly preferred. A 5-pyrazolone-based coupler having a ballast group as described in European Pat. No. 73,636 provides a high color density.

As pyrazole-based couplers, pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure,* RD No. 24220 (June 1984), and pyrazolopyrazoles as described in *Research Disclosure,* RD No. 24230 (June 1984) can be listed. Imidazo[1,2-b]pyrazoles as described in European Pat. No. 119,741 are preferred in that the yellow sub-absorption of colored dye is reduced and light fastness is good. Particularly preferred is pyrazolo[1,5-b][1,2,4]triazole as described in European Pat. No. 119,860.

As cyan couplers which can be used in the present invention, oil protect-type naphthol- and phenol couplers can be listed. Typical examples are a naphthol as described in U.S. Pat. No. 2,474,293, and preferably oxygen atom releasing type 2-equivalent naphthol as described in U.S. Pat. Nos. 4,052,212, 4,146,396, 4,228,233 and 4,296,200. Representative examples of the phenol coupler are described in U.S. Pat. Nos. 2,369,929, 2,801,171, 2,772,162, and 2,895,826. A cyan coupler which is fast to humidity and temperature is preferably used in the present invention. Typical examples are a phenol cyan coupler having an alkyl group (higher than an ethyl group) in the meta-position of the phenol nucleus as described in U.S. Pat. No. 3,772,002, a 2,5-diacylamino-substituted phenyl-based coupler as described in U.S. Pat. Nos. 2,772,162, 3,758,308, 4,126,396, 4,334,011, 4,327,173, West German Patent Application Laid-Open No. 3,329,729, and Japanese Patent Application (OPI) No. 166965/84, and a phenol coupler having a phenylureido group in the 2-position and an acylamino group in the 5-position as described in U.S. Pat. Nos. 3,446,622, 4,333,999, 4,451,559, and 4,427,767.

In order to correct unnecessary absorption in a short wavelength region of dyes formed from magenta and cyan couplers, it is preferred to use a colored coupler in combination for a color light-sensitive material for photography. Typical examples of such colored couplers are a yellow-colored magenta coupler as described in U.S. Pat. No. 4,163,670 and Japanese Patent Publication No. 39413/82, and a magenta colored cyan coupler as described in U.S. Pat. Nos. 4,004,929, 4,138,258 and British Pat. No. 1,146,368.

Graininess can be improved by using in combination a coupler which provides a colored dye having suitable diffusability. With regard to such fogged couplers, representative examples of the magenta coupler are described in U.S. Pat. No. 4,366,237 and British Pat. No. 2,125,570, and representative examples of the yellow, magenta, and cyan couplers are described in European Pat. No. 96,570 and West German Patent Application Laid-Open No. 3,234,533.

The dye-forming couplers and the above specific couplers may be in the form of dimers or polymers. Typical examples of such polymerized dye-forming couplers are described in U.S. Pat. Nos., 3,451,820 and 4,080,211. Representative examples of polymerized ma-genta couplers are described in British Pat. No. 2,102,173 and U.S. Pat. No. 4,367,282.

These couplers may be 4-equivalent or 2-equivalent in relation to silver ion. They may be colored couplers having the effect of color correction.

In order to meet the requirements for light-sensitive materials, two or more of the above various couplers can be used in the same light-sensitive layer, or the same compound can be incorporated into two or more different layers.

The couplers, DIR compounds of the present invention and other couplers which can be used in combination therewith can be incorporated in a silver halide emulsion layer by known techniques such as the method described in U.S. Pat. No. 2,322,027. For example, they are dissolved in compounds such as phthalic acid alkyl esters (e.g., dibutyl phthalate, and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and diethyl azerate), and trimethinic acid esters (e.g., tributyl trimethinate), or organic solvents having a boiling point of from about 30° to 150° C., such as lower alkyl acetates (e.g., ethyl acetate and butyl acetate), ethyl propionate, sec-butyl alcohol, methyl isobutyl ketone, β-ethoxyethyl acetate, and methyl cellosolve acetate, and then dispersed in hydrophilic colloid. The above high boiling point organic solvents and low boiling point organic solvents may be used in combination with each other.

In addition, the dispersion method utilizing polymers as described in Japanese Patent Publication Nos. 39853/76 and 59943/76 can be used.

When the coupler contains an acid group such as carboxylic acid and sulfonic acid, it is introduced in hydrophilic colloid in the form of an alkaline aqueous solution.

As a binder or protective colloid to be used in an emulsion layer and an intermediate layer of the light-sensitive material of the present invention, it is advantageous to use gelatin. Other hydrophilic colloids can also be used alone or in combination with gelatin.

As the gelatin, lime-treated gelatin and acid-treated gelatin both can be used. The method of preparation of gelatin is described in detail in Arthur Vice, *The Macromolecular Chemistry of Gelatin,* Academic Press Co., (1964).

As silver halide to be used in a photographic emulsion layer of the photographic light-sensitive material of the presnt invention, any of silver bromide, silver iodobromide, silver iodochlorobromide, silver chlorobromide, and silver chloride can be used. Preferred is silver iodobromide containing not more than 15 mol% of silver iodide. Particularly preferred is silver iodobromide containing from 2 to 12 mol% of silver iodide.

The average particle size of silver halide particles contained in the photographic emulsion is not critical. The average particle size is the average diameter of particles when the particles are spherical or nearly spherical, and when the particles are cubic, determined based on a projected area with the edge length of particle as a particle size and indicated in terms of an average. The average particle size of silver halide particles is preferably not more than 3 μm.

The particle size may be narrow or broad.

Silver halide particles in the photographic emulsion may have a regular crystal form such as cubic and octahedral, or have an irregular crystal form such as spherical and plate-like, or have a composite crystal form. The emulsion may comprise of a mixture of particles having various crystal forms.

There may be used an emulsion in which super flat silver halide particles, the diameter being at least 5 times the thickness, constitute at least 50% of the total projected area.

Silver halide particles may be such that the phase is different between the inside portion and the surface layer. They may be particles wherein a latent image is formed mainly in the inside portion.

Photographic emulsions which are used in the present invention can be prepared by the methods described in P. Glafkides, *Chimie et Physique Photographique,* Paul Montel Co., (1966), and V. L. Zelikman, et al., *Making and Coating Photographic Emulsion,* The Focal Press Co., (1964). That is, any of the acid method, the neutral method and the ammonia method, and so forth can be employed. To react a soluble silver salt and a soluble halogen salt, any of the single jet method, the double jet method and a combination thereof can be employed.

A method of forming particles in the presence of an excess of silver ions (so-called reverse mixing method) can also be employed. As an example of the double jet method, a method in which the pAg in a liquid phase where silver halide is formed is maintained constant, i.e., so-called controlled double jet method can be employed.

In accordance with this method, an emulsion can be obtained containing silver halide particles having a crystal form which is regular and the particle size of which is uniform.

Two or more silver halide emulsions prepared separately may be used as a mixture.

In the course of formation or physical aging of silver halide particles, cadmium salts, zinc salts, lead salts, thallium salts, iridium salts or complex salts thereof, rhodium salts or its complex salts, iron salts or its complex salts, and the like may be allowed to coexist.

The silver halide emulsion is usually subjected to chemical sensitization. For this chemical sensitization, the methods described in H. Fieser ed., *Die Grundlagender Photographischen Prozesse mit Silber Halogeniden,* Akademische Verlagsgesellschaft, pp. 675–734 (1968) can be used.

For example, the sulfur sensitization method using sulfur-containing compounds capable of reacting with active gelatin and silver, such as thiosulfuric acid salts, thioureas, mercapto compounds and rhodanines; the reduction sensitization method using reducing substances such as stannous salts, amines, hydrazine derivatives, formamidinesulfinic acid and silane compounds; the noble metal sensitization method using noble metal compounds such as gold complex salts and the complex salts of Group VIII metals in the periodic table (e.g., Pt, Ir, and Pd); and so forth can be used alone or in combination with each other.

In photographic emulsions which are used in the present invention there can be incorporated various compounds for the purpose of preventing fog during the preparation, storage or photographic processing of the light-sensitive material, or of stabilizing photographic performance. That is, a number of compounds known as anti-foggants or stabilizers can be added, such as azoles, e.g., benzothiazolium salts, nitroimidazole salts, nitrobenzimidazoles, chlorobenzimidazoles, bromobenzimidazoles, mercaptothiazoles, mercaptobenzothiazole, mercaptobenzimidazoles, mercaptothiadiazoles, aminotriazoles, benzotriazoles, nitrobenzotriazoles, mercaptotetrazoles (particularly 1-phenyl-5-mercaptotetrazole), and the likes; mercaptopyrimidines; mercaptotriazines; thioketo compounds such as oxadolinethione; azaindene such as triazaindenes, tetraazaindenes (particularly 4-hydroxy-substituted (1,3,3a,7)tetraazaindenes), pentaazaindenes, and the like; benzenethiosulfonic acid, benzenesulfinic acid, and benzenesulfonic acid amide.

In photographic emulsion layers or other hydrophilic colloid layers of the light-sensitive material of the present invention may be incorporated various surface active agents for various purposes, e.g., as coating aids, or to prevent charging, improve sliding properties, accelerate emulsification and dispersion, prevent adhesion, and improve photographic properties (e.g., acceleration of development, hardening and sensitization).

In photographic emulsion layers of the photographic light-sensitive material of the present invention may be incorporated compounds such as polyalklene oxide or its ether, ester, amine and like derivatives, thioether compounds, thiomorpholines, quaternary ammonium salts, urethane derivatives, urea derivatives, imidazole derivatives and 3-pyrazolidones for the purpose of increasing sensitivity, increasing contrast or accelerating development.

The photographic light-sensitive material of the present invention can contain a dispersion of a water-insoluble or sparingly water-soluble synthetic polymer for the purpose of, e.g., improving the dimensional stability of photographic emulsion layers or other hydrophilic colloid layers. For this purpose, homo- and co-polymers of alkyl acrylate or methacrylate, alkoxyalkyl acrylate or methacrylate, glycidyl acrylate or methacrylate, acrylamide or methacrylamides, vinyl esters (e.g., vinyl acetate), acrylonitrile, olefins and stryene, and polymers of the above monomers and comonomers such as acrylic acid, methacrylic acid, $\alpha,\beta$-unsaturated dicarboxylic acids, hydroxyalkyl acrylate or methacrylate, sulfoalkyl acrylate or methacrylate, and styrenesulfonic acid can be used.

Photographic emulsions which are used in the present invention may be subjected to spectral sensitization using methine dyes, for example. Dyes which can be used include a cyanine dye, a merocyanine dye, a composite cyanine dye, a composite merocyanine dye, a holopolar cyanine dye, a hemicyanine dye, a styryl dye, and a hemioxonol dye. Particularly useful dyes are a cynaine dye, a merocyanine dye, and a composite merocyanine dye. To these dyes can be applied all nuclei commonly utilized in cyanine dyes as basic heterocyclic nuclei. These include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei resulting from fusion of the above nuclei to alicyclic hydrocarbon rings; and nuclei resulting from fusion of the above nuclei to aromatic hydrocarbon rings, such as an indolenine nucleus, a benzoindolenine nucleus, an indole nucleus, a benzoxazole nucleus, a naphthoxazole nucleus, benzothiazole nucleus, a naphthothiazole nucleus, a benzoselenazole nucleus, a benzimidazole nucleus, and a quinoline nucleus. These nuclei may be substituted in a carbon atom thereof.

In a merocyanine dye and a composite merocyanine dye, as nuclei having the ketomethylene structure, 5- and 6-membered heterocyclic nuclei such as a pyrazoline-5-one nucleus, a thiohydantoin nucleus, a 2-thioxazolidin-2,4-dione nucleus, a thiazolidin-2,4-dione nuclues, a rhodanine nucleus, and a thiobarbituric acid nucleus can be applied.

These sensitizing dyes may be used alone or in combination with each other. Combination of such sensitizing dyes are often used for the purpose of supersensitization.

In combination with these sensitizing dyes, dyes not having a spectral sensitization action by themselves or substances not substantially absorbing visible light but which exhibit a supersensitization effect may be incorporated in the emulsion. For example, aminostyryl compounds substituted with a nitrogen-containing heterocyclic group (e.g., compounds described in U.S. Pat. Nos. 2,933,390 and 3,635,721), aromatic organic acids/formaldehyde condensates (e.g., compounds as described in U.S. Pat. No. 3,743,510), cadmium salts, and azaindene compounds may be incorporated.

The photographic light-sensitive material of the present invention may contain an inorganic or organic hardening agent in its photographic emulsion layer or other hydrophilic colloid layer. For example, chromium salts (e.g., chromium alum and chromium acetate), aldehydes (e.g., formaldehyde, glyoxal and glutaraldehyde), N-methylol compounds (e.g., dimethylol urea and methyloldimethyl hydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid and mucophenoxychloric acid) can be used alone or in combination with each other.

In the light-sensitive material of the present invention, if its hydrophilic colloid layer contains dyes, ultraviolet absorbers and the like, these dyes and ultraviolet absorbers, etc., may be mordanted, for example, with cationic polymers.

The light-sensitive material of the present invention may contain, as anti-color foggants, hydroquinone derivatives, aminophenol derivatives, gallic acid derivatives, ascorbic acid derivatives, and the like.

The light-sensitive material of the present invention may contain an ultraviolet absorber in its hydrophilic colloid layer. For example, benzotriazole compounds substituted with an aryl group (e.g., compounds as described in U.S. Pat. No. 3,533,794), 4-thiazolidone compounds (e.g., compounds as described in U.S. Pat. Nos. 3,314,794 and 3,352,681), benzophenone compounds (e.g., compounds as described in Japanese Patent Application (OPI) No. 2784/71), cinnamic acid esters (e.g., compounds as described in U.S. Pat. Nos. 3,705,805 and 3,707,375), butadiene compounds (e.g., compounds as described in U.S. Pat. No. 4,045,229), and benzooxazole compounds (e.g., compounds as described in U.S. Pat. No. 3,700,455) can be used. Ultraviolet ray-absorbing couplers (e.g., $\alpha$-naphthol-based cyan dye-forming couplers), ultraviolet ray-absorbing polymers and the like may be used. These ultraviolet absorbers may be mordanted in a specific layer.

The light-sensitive material of the present invention may contin water-soluble dyes in its hydrophilic colloid layer as filter dyes or for various purposes, such as prevention of irradiation. These dyes include an oxonol dye, a hemioxonol dye, a styryl dye, a merocyanine dye, a cyanine dye, and an azo dye. Of these dyes, an oxonol dye, a hemioxonol dye and a merocyanine dye are useful.

In the light-sensitive material of the present invention, anti-fading agents can be used in combination. Color image stabilizers which are used in the present invention can be used alone or as mixtures comprising two or more thereof. Known anti-fading agents include hydroquinone derivatives, gallic acid derivatives, p-alkoxyphenols, poxyphenyl derivatives, and bisphenols.

The light-sensitive material of the present invention can be processed by known methods and using known processing solutions as described, for example, in *Research Disclosure,* RD No. 176, December, 1978, pp. 28≧30. The processing temperature is generally within the range of from 18° to 50° C., but temperatures exceeding 50° C. or lower than 18° C. can be employed.

A color developer is generally composed of an alkaline aqueous solution containing a color developing agent. As such color developing agents, known primary aromatic amine developing agents, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, and 4-amino-3-methyl-N-ethyl-N-β-methoxyethylaniline) can be used.

In addition, color developing agents as described in F. A. Mason, *Photographic Processing Chemistry,* Focal Press Co., (1966), pp. 226–229, U.S. Pat. Nos. 2,193,015, 2,592,364 and Japanese Patent Application (OPI) No. 64933/73.

The color developer can further contain pH buffers such as the sulfite, carbonate, borate and phosphate of alkali metal, and development inhibitors or anti-foggants such as bromides, iodides, and organic anti-foggants. If desired, a hard water-softening agent, a perservative (e.g., hydroxylamine), an organic solvent (e.g., benzyl alcohol and diethylene glycol), a development accelerator (e.g., polyethylene glycol, quaternary ammonium salts and amines), a dye-forming coupler, a competetive coupler, a fogging agent (e.g., sodium boron hydride), an auxiliary developing agent (e.g., 1-phenyl-3-pyrazolidone), a tackifier, a polycarboxylic acid-based chelating agent, an antioxidant, and the like may be incorporated.

After color development, the photographic emulsion layer is usually bleached. This bleaching may be carried out independently from or simultaneously with fixation. Bleaching agents which can be used include polyvalent metal (e.g., iron (III), cobalt (III), chromium (VI) and copper (II)) compounds, peracids, quinones, and nitroso compounds.

For example, ferricyanides, perchromic acid salts, organic complex salts of iron (III) or cobalt (III), such as complex salts of aminopolycarboxylic acids such as ethylenediaminetetraacetic acid, nitrilotriacetic acid, and 1,3-di-amino-2-propanoltetraacetic acid, or organic acids such as citric acid, tartaric acid and lactic acid; persulfuric acid salts and permanganic acid salts, nitosophenol; and the like can be used. Of these compounds, potassium ferricyanide, sodium iron (III) ethylenediaminetetraacetate, and ammonium iron (III) ethylenediaminetetraacetate are particularly useful. An ethylenediaminetetraacetic acid iron (III) complex salt is useful in both an independent bleaching solution and a monobath bleach-fixing solution.

A fixing solution having a commonly used composition can be used. As fixing agents, as well as thiosulfuric acid salts and thiocyanic acid salts, organic sulfur compounds known to be effective as fixing agents can be used. The fixing solution may contain a water-soluble aluminum salt as a hardening agent.

After the fixation or bleach-fixation, treatments such as water washing and stabilization are generally applied. Convenient methods such as a method in which only the water washing process is applied, and a method in which water-washing is not substantially applied but only stabilization is applied can be employed (the method is disclosed, for example, in Japanese Patent Application (OPI) No. 8543/82).

The water to be used in the washing process can contain known additives. For example, a chelating agent (e.g., inorganic phosphoric acid, aminopolycarboxylic acid and organic phosphoric acid), a germicide preventing multiplication of various bacteria and algae, an antimoulding agent, a hardening agent (e.g., magnesium and aluminum salts), and a surface active agent preventing dry load and unevenness can be used. In addition, compounds as described in L. E. West, *Water Quality Criteria,* Photographic Science and Engineering, Vo. 9, No. 6, pp 344–359 (1965) can be used.

For the washing process, if desired, two or more vessels can be used. The amount of water used can be saved by employing a multi-stage countercurrent washing method (e.g., 2 to 9 stages).

As a stabilizer to be used in the stabilization step, a processing solution to stabilize a dye image is used. For example, a solution having a buffering powerr of pH 3 to 6 and a solution containing aldehyde (e.g., formalin) can be used. In the stabilizer can be incorporated, if desired, a fluorescent whitener, a chelating agent, a germicide, an antimoulding agent, a hardening agent, a surface active agent and so forth.

The stabilization may be carried out using two or more vessels. By employing a multi-stage (e.g., 2 to 9 stage) countercurrent stabilization method, the amount of the stabilizer used can be saved and furthermore the washing step can be omitted.

The present invention is described below in greater detail with reference to the following examples, although it is not limited thereto.

The structures of compounds used in the present examples, other than the compounds of the present invention, and methods of processing light-sensitive material samples are shown in the last part of the examples.

EXAMPLE 1

For evaluation of the effectiveness of compounds of the present invention, a multi-layer color light-sensitive material sample 101 comprising a cellulose triacetate film support and the following layer on the support was prepared.

Sample 101

The amount of silver halide or colloid silver coated is indicated by the amount calculated as silver in units of $g/m^2$; the amount of coupler, additives (except sensitizing dyes), and gelatin coated is indicated in units of $g/m^2$; and the amount of a sensitizing dye coated is indicated in number of mols per mol of silver halide in the same layer.

| | |
|---|---|
| First Layer (Antihalation Layer) | |
| Black colloid silver | 0.2 |
| Gelatin | 1.3 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| Second Layer (Intermediate Layer) | |
| Finely divided silver bromide (average particle diameter: 0.07 μm) | 0.15 |
| Gelatin | 1.0 |
| Colored coupler C-1 | 0.1 |
| Colored coupler C-2 | 0.01 |
| Dispersion oil Oil-1 | 0.1 |
| Third Layer (First Red-Sensitive Emulsion Layer) | |
| Silver iodobromide emulsion (silver bromide: 4 mol %; average particle diameter: 0.4 μm) | 1.8 |
| Gelatin | 1.6 |
| Sensitizing dye I | $4.5 \times 10^{-4}$ |
| Sensitizing dye II | $1.5 \times 10^{-4}$ |
| Coupler C-3 | 0.30 |
| Coupler C-4 | 0.40 |
| Coupler C-5 | 0.02 |
| Coupler C-2 | 0.003 |
| Dispersion oil Oil-1 | 0.03 |
| Dispersion oil Oil-3 | 0.012 |
| Fourth Layer (Second Red-Sensitive Emulsion Layer) | |
| Silver iodobromide emulsion (silver iodide: 7 mol %; average particle diameter: 0.8 μm) | 1.2 |
| Gelatin | 1.0 |
| Sensitizing dye I | $3 \times 10^{-4}$ |
| Sensitizing dye II | $1 \times 10^{-4}$ |
| Coupler C-6 | 0.05 |
| Coupler C-7 | 0.015 |
| Coupler C-2 | 0.01 |
| Dispersion oil Oil-1 | 0.01 |
| Dispersion oil Oil-2 | 0.05 |
| Fifth Layer (Intermediate Layer) | |
| Gelatin | 1.0 |
| Compound Cpd-A | 0.03 |
| Dispersion oil Oil-1 | 0.05 |
| Dispersion oil Oil-2 | 0.05 |
| Sixth Layer (First Green-Sensitive Emulsion Layer) | |
| Silver iodobromide emulsion (silver iodide: 5 mol %; average particle diameter: 0.4 μm) | 0.9 |
| Sensitizing dye III | $5 \times 10^{-4}$ |
| Sensitizing dye IV | $2 \times 10^{-4}$ |
| Gelatin | 1.0 |
| Coupler C-8 | 0.3 |
| Coupler C-5 | 0.06 |
| Coupler C-1 | 0.15 |
| Dispersion oil Oil-1 | 0.5 |
| Seventh Layer (Second Green-Sensitive Emulsion Layer) | |
| Silver iodobromide emulsion (silver iodide: 7 mol %; average particle diameter: 0.8 μm) | 0.95 |
| Gelatin | 1.0 |
| Sensitizing dye III | $3.5 \times 10^{-4}$ |
| Sensitizing dye IV | $1.4 \times 10^{-4}$ |
| Coupler C-10 | 0.05 |
| Coupler C-11 | 0.01 |
| Coupler C-12 | 0.08 |
| Coupler C-1 | 0.02 |
| Coupler C-9 | 0.02 |
| Dispersion oil Oil-1 | 0.10 |
| Dispersion oil Oil-2 | 0.05 |
| Eighth Layer (Yellow Filter Layer) | |
| Gelatin | 1.2 |
| Yellow colloid silver | 0.08 |
| Compound Cpd-B | 0.1 |
| Dispersion oil Oil-1 | 0.3 |
| Ninth Layer (First Blue-Sensitive Emulsion Layer) | |
| Monodisperse silver iodobromide emulsion (silver iodide: 5 mol %; average particle diameter: 0.5 μm) | 0.5 |

-continued

| | |
|---|---|
| Gelatin | 1.0 |
| Sensitizing dye V | $2 \times 10^{-4}$ |
| Coupler C-13 | 0.9 |
| Dispersion oil Oil-1 | 0.2 |
| Tenth Layer (Second Blue-Sensitive Emulsion Layer) | |
| Silver iodobromide (silver iodide: 10 mol %; average particle diameter: 1.5 μm) | 0.6 |
| Gelatin | 0.6 |
| Sensitizing dye V | $1 \times 10^{-4}$ |
| Coupler C-13 | 0.25 |
| Dispersion oil Oil-1 | 0.07 |
| Eleventh Layer (First Protective Layer) | |
| Gelatin | 0.8 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| Twelfth Layer (Second Protective Layer) | |
| Finely divided silver bromide (average particle diameter: 0.07 μm) | 0.5 |
| Gelatin | 0.45 |
| Polymethyl methacrylate particles (diameter: 1.5 μm) | 0.2 |
| Hardener H-1 | 0.4 |
| Formaldehyde scavenger S-1 | 0.3 |
| Formaldehyde scavenger S-2 | 0.3 |

To each layer, as well as the above ingredients, a surface active agent was added as a coating aid.

The light-sensitive material thus prepared was referred to as "Sample 101".

Sample 102

A light-sensitive material was prepared in the same manner as in the preparation of Sample 101, except that Coupler C-13 of the ninth layer was replaced with an equimolar amount of a compound releasing a yellow dye, Compound Y-18, of the present invention. Upon development of this light-sensitive material with a color developer having the composition as shown below, the yellow density was significantly higher than that of Sample 101. Thus, Sample 102 was prepared in the same manner as in the preparation of Sample 101, except that the amount of Compound Y-18 of the present invention being used was controlled to 55 mol% of the amount of C-13, and correspondingly the amounts of the dispersion high boiling organic solvent and the gelatin used were each decreased by 30%, while still obtaining a gradation equal to that of Sample 101.

Sample 103

A light-sensitive material was prepared in the same manner as in the preparation of Sample 101, except that in addition to Coupler C-13 of the ninth layer, a DIR compound C-5 was added in an amount 7 mol% per mol of Coupler C-13. Upon color development of the light-sensitive material in the manner as described below, a reduction in density was 10% of that in Sample 1. Thus Sample 103 was prepared in the same manner as in the preparation of Sample 101 except that the amount of the coupler used was increased in order that the gradation was equal to that of Sample 101.

Samples 104 to 107

Samples 104 to 107 were prepared in the same manner as in the preparation of Sample 103 except that the DIR compound, C-5, of the ninth layer was replaced with T-102, T-104, T-105 and T-106, the molar percentage of T-102, T-104, T-105, and T-106 based on Coupler C-13 were 13%, 8%, 18% and 17%, respectively, so as to make the gradation nearly equal to that of Sample 103.

Sample 108

A light-sensitive material was prepared in the same manner as in the preparation of Sample 103 except that the Coupler C-13 in the ninth layer was replaced with an equimolar amount of Compound Y-18 releasing a yellow dye of the present invention. Upon color development of the light-sensitive material in the manner as described hereinafter, a marked increase in yellow density was observed. Thus, Sample 108 was prepared in the same manner as in the preparation of Sample 103 except that the amount of Compound Y-18 of the present invention being used was 60 mol% of C-13 and correspondingly the amounts of the dispersion high boiling solvent and gelatin used were decreased by 30%.

Samples 109 to 112

Samples 109 to 112 were prepared in the same manner as in the preparation of Sample 108, except that the DIR compound C-5 in the ninth layer was replaced with T-102, T-104, T-105 and T-106, the molar percentage of T-102, T-104, T-105, and T-106 based on Coupler Y-18 being 14%, 7%, 19% and 19%, respectively, so as to make the gradation nearly equal to that of Sample 108.

Samples 109 to 112 were exposed wedgewise to white light, and then, upon development in the manner as described hereinafter, there were obtained images which were nearly equal in sensitivity and gradation.

The above samples were measured for the MTF (modulation transfer function) value at a frequency of 40 lines per millimeter of the yellow image and granularity according to the RMS (root mean square) method.

A method for measuring the MTF is described in T. H. James, ed., *The Theory of the Photographic Process*, 4th ed., MacMillan Co., (1977), pp. 604–607.

The RMS method is described in *Photographic Science and Engineering*, Vol. 19, No. 4 (1975), pp. 235–238 under the title of RMS Granularity; Determination of Just Noticeable Differences. The aperture was 48 μm.

The results are shown in Table 1.

TABLE 1

| | Sample | Yellow Coupler | DIR Compound | MTF (Yellow Image) | RMS (Yellow Dye) |
|---|---|---|---|---|---|
| Comparative Sample | 101 | C-13 (comparative coupler) | — | 0.51 | 0.031 |
| | 102 | Y-18 (coupler of the invention) | — | 0.58 | 0.034 |
| | 103 | C-13 (comparative coupler) | C-5 | 0.54 | 0.027 |
| | 104 | C-13 (comparative coupler) | T-102 | 0.53 | 0.029 |
| | 105 | C-13 (comparative coupler) | T-104 | 0.55 | 0.029 |
| | 106 | C-13 (comparative coupler) | T-105 | 0.53 | 0.028 |
| | 107 | C-13 (comparative coupler) | T-106 | 0.54 | 0.028 |
| Sample of the Invention | 108 | Y-18 (coupler of the invention) | C-5 | 0.59 | 0.027 |
| | 109 | Y-18 (coupler of the invention) | T-102 | 0.59 | 0.028 |
| | 110 | Y-18 (coupler of the invention) | T-104 | 0.58 | 0.028 |
| | 111 | Y-18 (coupler of the invention) | T-105 | 0.59 | 0.028 |
| | 112 | Y-18 (coupler of the invention) | T-106 | 0.58 | 0.029 |

It can be seen from the results of Table 1 that Samples 108 to 112 of the present invention are improved in sharpness without deterioration of graininess as compared with the comparative samples. Particularly in connection with an improvement of graininess by using the DIR compound in combination, the couplers of the present invention produce a greater effect than the comparative couplers.

Samples 113, 115 and 117

Samples 113, 115, and 117 were prepared in the same manner as in Sample 102 except that the coupler Y-18 in the ninth layer was replaced with an equimolar amount of Couplers Y-2, Y-4 and Y-9, all being couplers of the present invention, respectively, so as to make the gradation nearly equal to that of Sample 102.

Samples 114, 116 and 118

Samples 114, 116, and 118 were prepared in the same manner as in Sample 108 except that the Coupler Y-18 in the ninth layer was replaced with an equimolar amount of Couplers Y-2, Y-4, and Y-9 of the present invention, respectively.

Samples 113 to 118 were exposed wedgewise to white light, and then, upon color development in the manner as described hereinafter, there were obtained images which were nearly equal in sensitivity and gradation. These samples were measured for MTF and RMS by the same methods as described hereinabove. The results are shown in Table 2.

TABLE 2

| Sample | Yellow Coupler | DIR Compound | MTF (Yellow Image) | RMS (Yellow Image) |
|---|---|---|---|---|
| 113 (comparative example) | Y-2 | — | 0.59 | 0.033 |
| 114 (example of the invention) | Y-2 | C-5 | 0.59 | 0.028 |
| 115 (comparative example) | Y-4 | — | 0.58 | 0.032 |
| 116 (example of the invention) | Y-4 | C-5 | 0.58 | 0.027 |
| 117 (comparative example) | Y-9 | — | 0.58 | 0.033 |
| 118 (example of the invention) | Y-9 | C-5 | 0.58 | 0.028 |

It can be seen from the results of Table 2 that the samples of the present invention are improved in granularity.

Sample 119

A light-sensitive material was prepared in the same manner as in Sample 103, except that the polymer Coupler C-8 in the sixth layer was replaced with an equimolar amount (as a coupler unit) of Coupler M-4 of the present invention. Upon color development of the light-sensitive material, a magenta color image of very high density was obtained. At the same time, the masking effect was increased. Thus, the amount of the Coupler M-4 of the present invention being used was decreased to 45% of the original, and at the same time, the amount of the colored Coupler C-1 used was decreased to 50%. Correspondingly the amounts of gelatin and the high boiling organic solvent for dispersion being used were decreased to control the gradation. Sample 119 was prepared in the same manner as in Sample 103, except for the above points.

Sample 120

Sample 120 was prepared in the same manner as in Sample 119, except that the Coupler C-5 in the sixth layer was removed, the amount of the coating solution being coated as the sixth layer was decreased to control the gradation.

Sample 121

Sample 121 was prepared in the same manner as in Sample 103, except that the Coupler C-5 of the sixth layer was removed, and the amount of the coating solution being coated as the sixth layer was decreased to control the gradation.

Samples 119, 120, and 121 were measured for MTF and RMS in the same manner as described above. The results are shown in Table 3.

TABLE 3

| Sample | Magenta Coupler | DIR Compound | MTF (Magenta Image) | RMS (Magenta Image) |
|---|---|---|---|---|
| 121 (Comparative Example) | C-8 | — | 0.45 | 0.010 |
| 120 (Comparative Example) | M-4 | — | 0.50 | 0.013 |
| 119 (Example of the Invention) | M-4 | C-5 | 0.50 | 0.010 |

It can be seen from the results of Table 3 that in the sample of the present invention, even in the magenta color image, sharpness was improved without deterioration of granularity as compared with the comparative examples.

The chemical structures and chemical names of the compounds used in the above examples are shown below.

UV-1

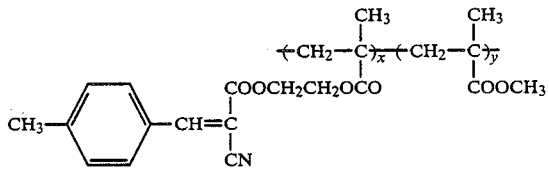

x/y = 7/3 by weight

UV-2

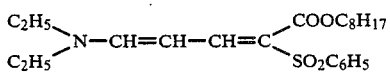

Oil-1 Tricresyl phosphate
Oil-2 Dibutyl phthalate
Oil-3 Bis(2-ethylhexyl)phthalate -continued
C-1
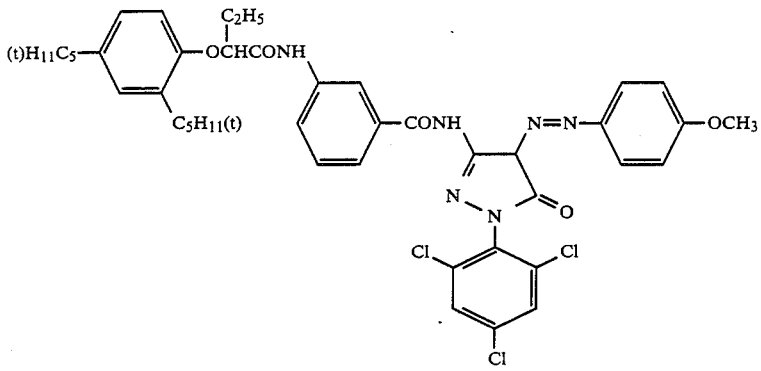
C-2
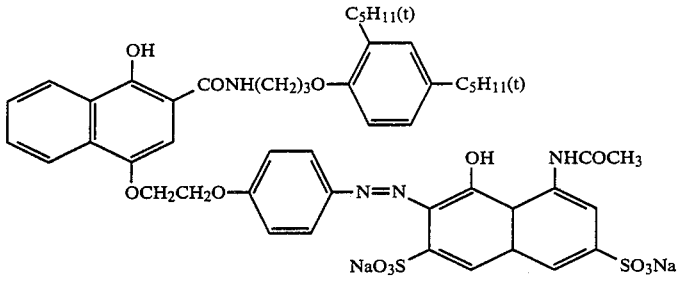
C-3
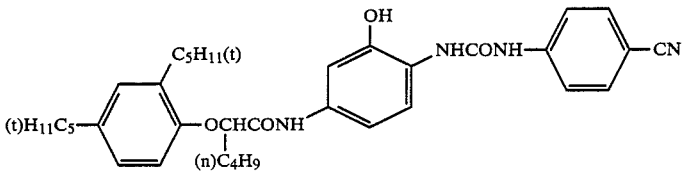
C-4
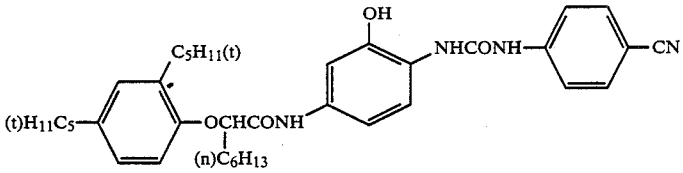
C-5
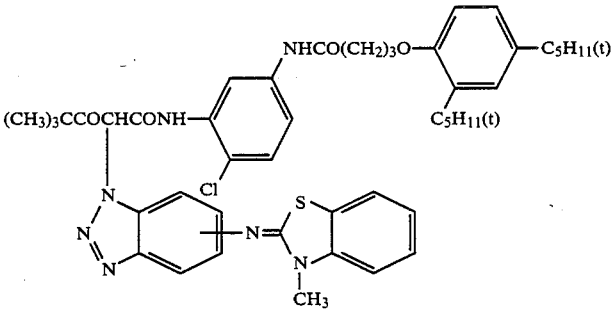

-continued
C-6
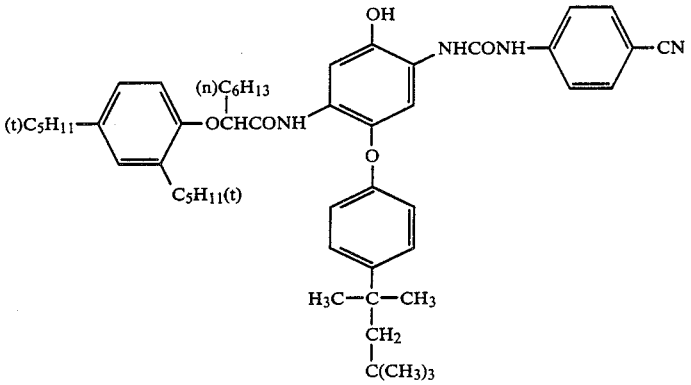
C-7
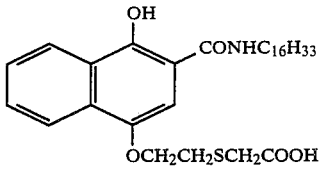
C-8
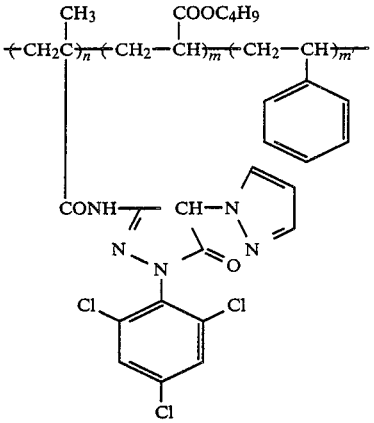
n/m + m' = /by weight
m/m' = /by weight
Molecular weight: about 20,000
C-9
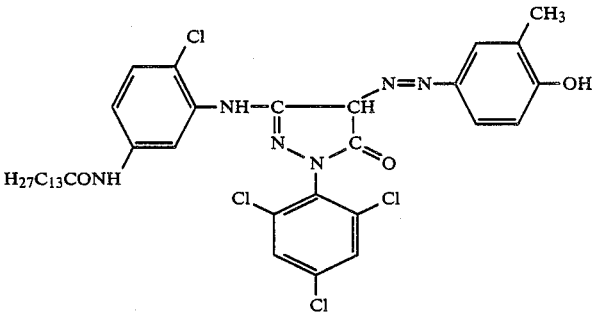

-continued
C-10
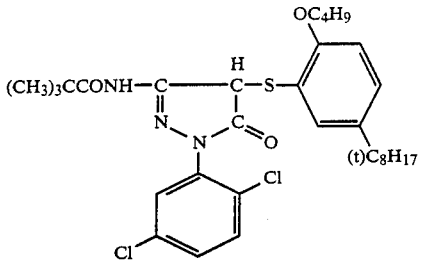
C-11
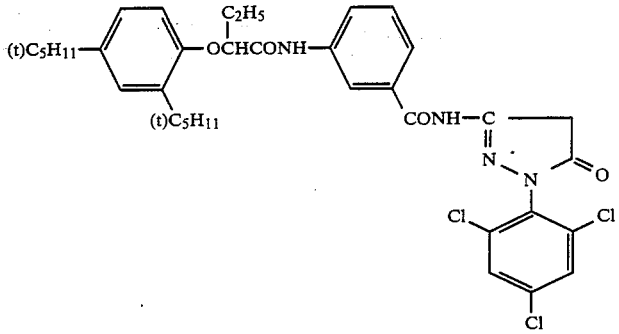
C-12
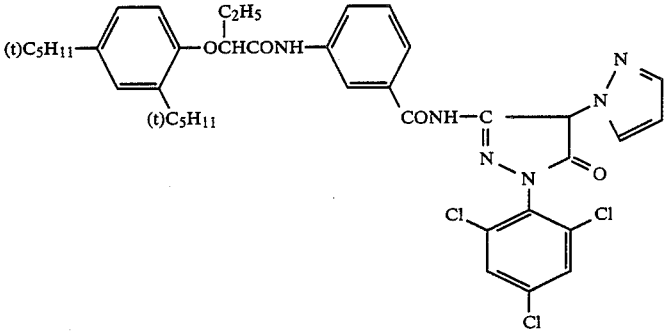
C-13
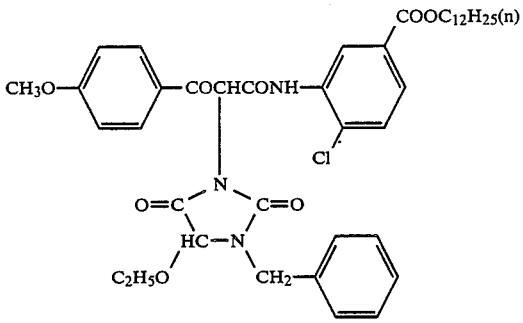
Cpd A
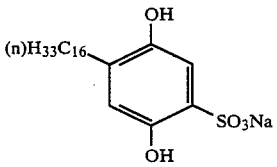
Cpd-B
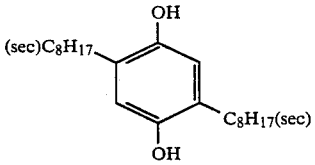

-continued

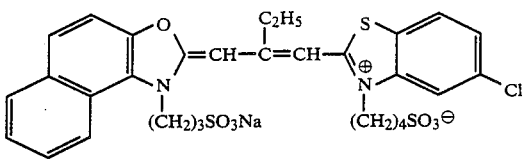

Sensitizing Dye I

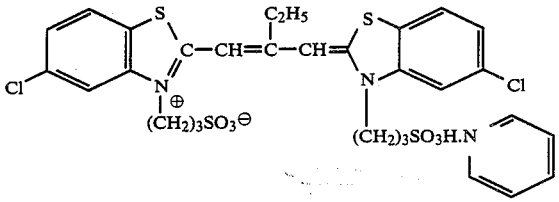

Sensitizing Dye II

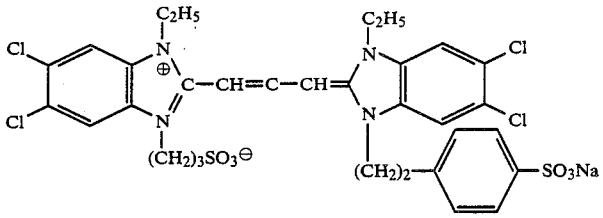

Sensitizing Dye III

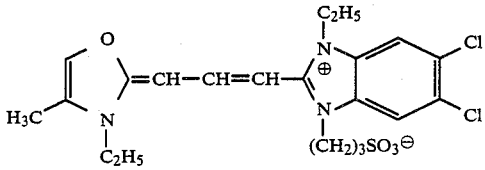

Sensitizing Dye IV

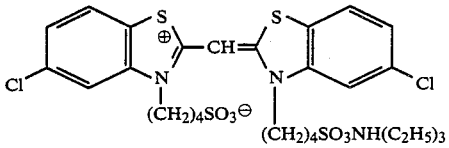

Sensitizing Dye V

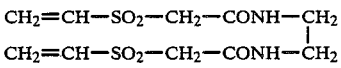

H-1

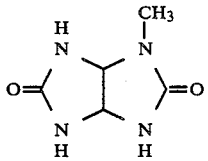

S-1

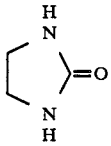

S-2

The samples of Examples 1 and 2 were developed at 38° C. according to the following process.

| | |
|---|---|
| Color Development | 3.15 min |
| Bleaching | 6.5 min |
| Water washing | 2.16 min |
| Fixation | 4.33 min |
| Water washing | 3.25 min |

-continued

| | |
|---|---|
| Stabilization | 1.08 min |

The composition of a processing solution used at each step was as follows.

Color Developer

-continued

| | |
|---|---|
| Diethylenetriaminepentaacetic acid | 1.0 g |
| 1-Hydroxyethylidene-1,1-diphosphoric acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—β-hydroxyethyl-amino)-2-methylaniline sulfate | 4.5 g |
| Water to make | 1.0 liter (pH = 10.0) |
| Bleaching Solution | |
| Iron(III) ammonium ethylene-diaminetetraacetate | 100.0 g |
| Disodium ethylenediaminetetra-acetate | 10.0 g |
| Ammonium bromide | 150.0 g |
| Ammonium nitrate | 10.0 g |
| Water to make | 1.0 liter (pH = 6.0) |
| Fixing Solution | |
| Disodium ethylenediamine-tetraacetate | 1.0 g |
| Sodium sulfite | 4.0 g |
| Aqueous solution of ammonium thiosulfate (70%) | 175.0 ml |
| Sodium hydrogensulfite | 4.6 g |
| Water to make | 1.0 liter (pH = 6.6) |
| Stabilizer | |
| Formalin (40 wt % formaldehyde) | 2.0 ml |
| Polyoxyethylene-p-monononylphenyl ether (average degree of polymerization: about 10) | 0.3 g |
| Water to make | 1.0 liter |

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising:

a coupler having a dye moiety, the maximum absorption wavelength of which is shifted to the shorter wavelength by a bond cleaving, directly or through a timing group, due to a coupling reaction with an oxidized product of an aromatic primary amine developing agent, and, as a result of the coupling reaction, forming a compound having a dye moiety which has the same maximum absorption wavelength as before the shifting to the shorter wavelength side; and a compound releasing a development inhibitor or a precursor thereof, directly or through a timing group, upon reacting with the oxidized product of the aromatic primary amine-based developing agent wherein said coupler is represented by formula (I)

$$Cp—(TIME)_n—X—Dye \quad (I)$$

wherein Cp is a coupler radical and the bond between Cp and $(TIME)_n$—X—DYE is capable to cleave upon the coupling reaction with an oxidized product of an aromatic primary amine developing agent, TIME is a timing group, n is 0, 1 or 2, Dye is a dye moiety, X is an auxochrome radical of the dye and TIME is selected from the group consisting of groups represented by the following formulae (T-4), (T-5), (T-6), (T-7), (T-8), (T-9) or (T-10):

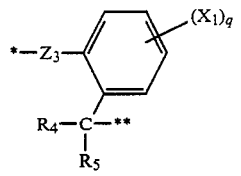

(T-4)

wherein $Z_3$ represents —S— or

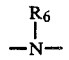

wherein $R_6$ expresses an aliphatic-, alicyclic- or aromatic-hydrocarbon group, acyl, sulfonyl or heterocyclic group; $R_4$ and $R_5$ each represents a hydrogen atom, an aliphatic-, alicyclic-, or aromatic hydrocarbon group, or a heterocyclic group; q represents an integer of from 0 to the total number of hydrogen atoms in the ring which are able to be substituted; $X_1$ represents an aliphatic-, aromatic, or alicyclic-hydrocarbon group or a heterocyclic group,

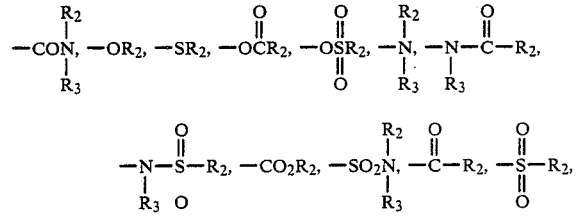

a cyano group, halogen atoms or a nitro group (wherein $R_2$ and $R_3$ each represents the same groups as described for $R_4$), or when q is 2 or more, $X_1$ links to each other to form a ring;

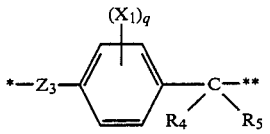

(T-5)

wherein $Z_3$, $X_1$, $R_4$, $R_5$, and q denote the same meanings as those defined for formula (T-4);

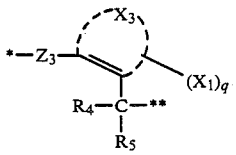

(T-6)

wherein $X_3$ is an atomic group which comprises at least one atom selected from the class consisting of carbon, nitrogen, oxygen and sulfur and which is necessary to form a 5- to 7-membered heterocyclic group, or $X_3$ is a condensed ring of said heterocyclic group with a benzene ring or a 5- to 7-membered heterocyclic group; and $R_4$, $R_5$, $Z_3$, $X_1$ and q denote the same meanings as those defined for formula (T-4);

(T-7)

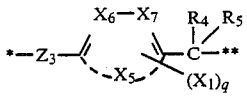

wherein $X_5$ is an atomic group which comprises at least one atom selected from the class consisting of carbon, nitrogen, oxygen, and sulfur and which is necessary to form a 5- or 7-membered heterocyclic group, or $X_5$ is a condensed ring of said heterocyclic group with a benzene ring or a 5- to 7-membered heterocyclic group; $X_6$ and $X_7$ is

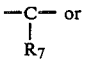

—N= (wherein $R_7$ expresses a hydrogen atom, an aliphatic-, alicyclic- or aromatic-hydrocarbon group); and $R_4$, $R_5$, $Z_3$, $X_1$ and q denote the same meanings as those defined for formula (T-4);

(T-8)

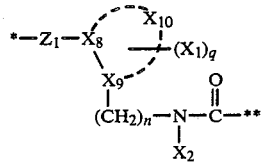

wherein $X_{10}$ is an atomic group which comprises at least one atom selected from the class consisting of carbon, nitrogen, oxygen, and sulfur and which is necessary to form a 5- to 7-membered heterocyclic group, or $X_{10}$ is a condensed ring of said heterocyclic group with a benzene ring or a 5- to 7-membered heterocyclic group; $X_8$ and $X_9$ are

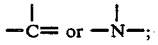

$Z_1$ represents

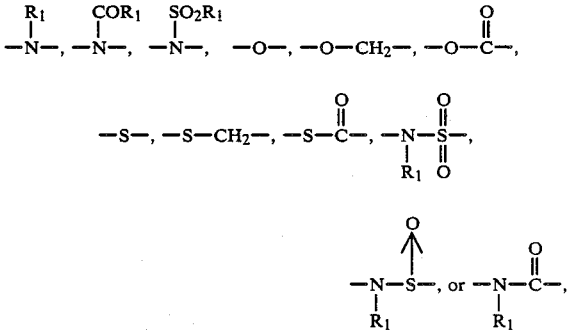

$X_1$, and q denote the same meanings as those defined for formula (T-4), n represents 0, 1 or 2, $X_2$ represents the same groups as described for $R_4$;

(T-9)

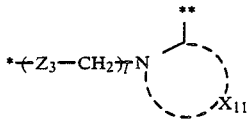

wherein $X_{11}$ denotes the same meaning as $X_{10}$ defined for formula (T-8), $Z_3$ denotes the same meaning as that defind for formula (T-4) and l expresses 0 or 1;

(T-10)

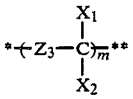

wherein $X_1$ denotes the same meanings as defined for formula (T-4), $X_2$ denotes the same meaning as $R_4$ in formula (T-4), $Z_3$ denotes the same meaning as that for formula (T-4) and m is an integer of from 1 to 4; in said formulae (T-4) to (T-10), aliphatic-, alicyclic-, and aromatic-hydrocarbon group, heterocyclic group and condensed ring are substituted and unsubstituted.

2. A silver halide color photographic light-sensitive material as claimed in claim 1, wherein said dye is a hydroxy group-substituted aromatic azo dye or a hydroxy group-substituted heterocyclic aromatic azo dye having a radical represented by formula (II)

$$-X-Y-N=N-Z \qquad \text{(II)}$$

wherein X is an auxochrome radical of the dye, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

3. A silver halide color photographic light-sensitive material as claimed in claim 2, wherein X is selected from the group consisting of an oxygen atom and a sulfur atom.

4. A silver halide color photographic light-sensitive material as claimed in claim 2, wherein Y and Z each is an aromatic group or an unsaturated heterocyclic group.

5. A silver halide color photographic light-sensitive material as claimed in claim 2, wherein said radical is selected from the group consisting of those represented by formulae (D-1), (D-2), (D-3), (D-4), (D-5) and (D-6):

(D-1)

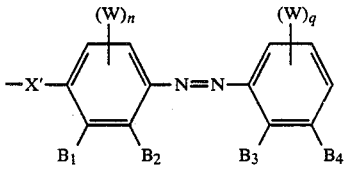

-continued (D-2)

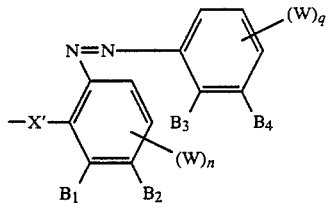

(D-3)

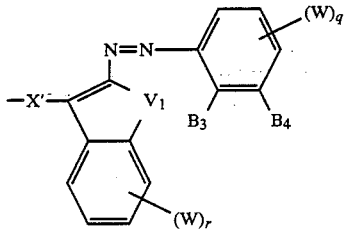

(D-4)

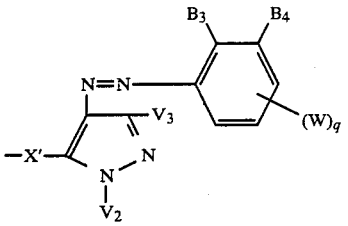

(D-5)

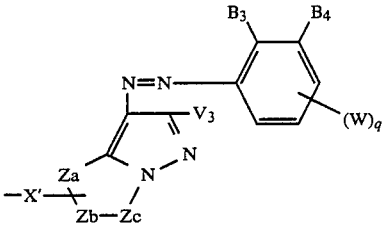

(D-6)

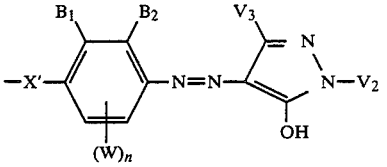

wherein X' is an oxygen atom or a sulfur atom, W is a substituent, n is 0, 1, or 2 q is 0, 1, 2, or 3, and r is 0 or an integer of 1 to 4, $B_1$, $B_2$, $B_3$, and $B_4$ are each a hydrogen atom or a substituent, or $B_1$ and $B_2$, and $B_3$ and $B_4$ combine together to form substituted or unsubstituted condensed ring, $V_1$ is an oxygen atom, a sulfur atom, or a substituted or unsubstituted imino group, $V_2$ is an aliphatic or alicyclic hydrocarbon radical, an aryl group, or a heterocyclic radical, $V_3$ has at most 32 carbon atoms and is a substituted or unsubstituted straight or branched alkyl group, an alkenyl group, a cyclic alkyl group, an aralkyl group, a cyclic alkenyl group, an aryl group, a heterocyclic group, an alkoxycarbonyl group, an aryloxycarbonyl group, an aralkyloxycarbonyl group, an alkoxy group, an aryloxy group, an acylamino group, a diacylamino group, an N-alkylacylamino group, an N-arylacylamno group, a ureido group, a mono-, di-, or tri-substituted ureido group, a mono- or di-alkylamino group, a cycloamino group, a sulfonamido group, substituted groups of these groups, a halogen atom, or a cyano group, Za, Zb, and Zc each is a methine group, a substituted methine group, =N— or —NH—, and one of the Za—Zb and Zb—Zc bonds is a double bond and the other is a single bond, provided that Za, Zb, and Zc are not N at the same time, when the Zb—Zc is a carbon-carbon double bond, it constitutes part of a substituted or unsubstituted aromatic ring, and any one of Za, Zb, and Zc combines with X' to form —X'—C=.

6. A silver halide color photographic light-sensitive material as claimed in claim 1, wherein Cp is a coupler radical selected from the group consisting of groups represented b formula (III), (IV), (V), (VI), (VII), (VIII), (IX), (X), (XI), (XII), or (XIII)

Formula (III)

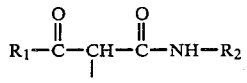

Formula (IV)

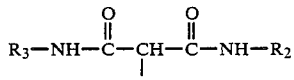

Formula (V)

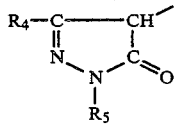

Formula (VI)

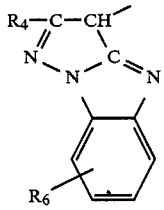

Formula (VII)

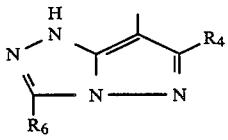

Formula (VIII)

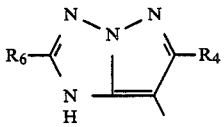

Formula (IX)

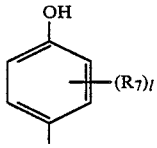

Formula (X)

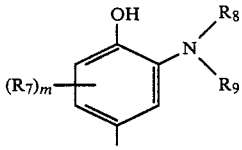

-continued

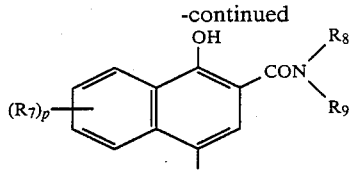

Formula (XI)

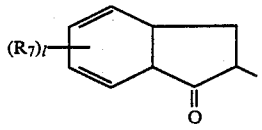

Formula (XII)

$R_{10}-\underset{|}{CH}-R_{11}$

Formula (XIII)

wherein a free bond from the coupling site in the formulae indicates a position to which the coupling release group is linked, when $R_1$, $R_2$, $R_3$, $R_4$, $R_5$, $R_6$, $R_7$, $R_8$, $R_9$, $R_{10}$, or $R_{11}$ contains an anti-diffusing group, it is selected so that the total number of carbon atoms is from 8 to 32, $R_1$ represents a substituted or unsubstituted aliphatic- or alicyclic-hydrocarbon group, aryl group, alkoxy group, or heterocyclic group, $R_2$ and $R_3$ each represents a substituted or unsubstituted group or a heterocyclic group, or $R_1$, $R_2$, and $R_3$ each represents a substituent resulting from condensation of a phenyl group with another ring and substituted group thereof, when $R_1$, $R_2$, and $R_3$ each represents a heterocyclic ring, the heterocyclic group is linked to a carbon atom of the carbonyl group of the acyl group in alpha-acylacetamido or to a nitrogen atom of the amido group in each formula through one of the carbon atoms constituting the rings; $R_5$ is a group having at most 32 carbon atoms, and is a substituted or unsubstituted alkyl group, alkenyl group, cycloalkyl group, aralkyl group, cycloalkenyl group, or aryl group, or a substituted or unsubstituted heterocyclic group; $R_4$ represents a hydrogen atom and a group having at most 32 carbon atoms, said group is a substituted or unsubstituted alkyl group, alkenyl group, cycloalkyl group, aralkyl group, cycloalkenyl group, aryl group, heterocyclic group, alkoxycarbonyl group, aryloxycarbonyl, aralkyloxycarbonyl group, alkoxy group, aryloxy group, alkylthio group, arylthio group, acylamino group, diacylamino group, N-alkylacylamino group, N-arylacylamino group, ureido group, urethane group, thiourethane group, arylamino group, alkylamino group, cycloamino group, heterocyclic amine group, alkylcarbonyl group, arylcarbonyl group, sulfonamido group, carbamoyl group, sulfamoyl group, or mercapto group, or —COOM (M:H, an alkali metal atom, $NH_4$), a sulfo group, a cyano group, a hydroxyl group or a halogen atom; $R_6$ represents a hydrogen atom and a group having at most 32 carbon atoms, said group is a substituted or unsubstituted alkyl group, alkenyl group, cycloalkyl group, aralkyl group, a cycloalkenyl group, aryl group, heterocyclic group, alkoxy group, aryloxy group, alkoxycarbonyl group, aryloxycarbonyl group, acyloxy group, sulfo group, sulfamoyl group, carbamoyl group, acylamino group, diacylamino group, ureido group, urethane group, sulfonamido group, arylsulfonyl group, alkylsulfonyl group, arylthio group, alkylthio group, alkylamino group, dialkylamino group, anilino group, N-arylanilino group, N-alkylanilino group, N-acylanilino group, a hydroxyl group, or mercapto group, a cyano group, a halogen atom, —COOM (M:H, an alkali metal atom, $NH_4$), or a hydroxy group; $R_7$ represents a hydrogen atom, a halogen atom, a substituted or unsubstituted alkoxycarbonylamino group, aliphatic- or alicyclic-hydrocarbon group, N-arylureido group, acylamino group, group —O—$R_{12}$ or group —S—$R_{12}$ (wherein $R_{12}$ is an aliphatic- or alicyclic-hydrocarbon radical), $R_8$ and $R_9$ each represents a substituted or unsubstituted aliphatic- or alicyclic-hydrocarbon group, aryl group, or heterocyclic group, or one of $R_8$ and $R_9$ is a hydrogen atom, or $R_8$ and $R_9$ combine together to form a nitrogen-containing heterocyclic nucleus; l is an integer of 1 to 4, m is an integer of 1 to 3, and p is an integer of 1 to 5; $R_{10}$ repesents a group having at most 32 carbon atoms, said group is a substituted or unsubstituted arylcarbonyl group, alkanoyl group, alkanecarbamoyl group, alkoxycarbonyl group, or aryloxycarbonyl group; $R_{11}$ represents a group having at most 32 carbon atoms, said group is substituted or unsubstituted arylcarbonyl group, alkanoyl group having from 2 to 32 carbon atoms, arylcarbamoyl group, alkanecarbamoyl group having from 2 to 32 carbon atoms, alkoxycarbonyl group having from 2 to 32 carbon atoms, aryloxycarbonyl group, alkanesulfonyl group, arylsulfonyl group, aryl group, or 5- or 6-membered heterocyclic group.

7. A silver halide color photographic light-sensitive material as claimed in claim 1, wherein the coupler of formula (I) has further a polymer or copolymer moiety derived from at at least one monomer represented by formula (XV)

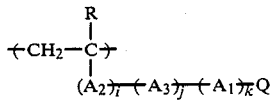

(XV)

wherein R represents a hydrogen atom, a lower alkyl group having from 1 to 4 carbon atoms, or a chlorine atom, $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH—, or —O—, $A_2$ represents —CONH— or —COO—, and $A_3$ represents a substituted or unsubstituted, straight or branched alkylene group a substituted or unsubstituted aralkylene group, or a substituted or unsubstituted arylene group, said $A_3$ has at most 10 carbon atoms; Q represents a compound radical represented by formula (I) and it is linked at any site of Cp, TIME, and Dye; and i, j and k are each 0 or 1, but they are not all 0 at the same time.

8. A silver halide color photographic light-sensitive material as claimed in claim 1, wherein said coupler is incorporated in at least one of light-sensitive silver halide layer and its adjacent layer.

9. A silver halide color photographic light-sensitive material as claimed in claim 8, wherein said coupler is incorporated in at least one layer in an amount of from 0.001 to 1 mol per mol of silver halide in said layer.

10. A silver halide color photographic light-sensitive material as claimed in claim 1, wherein said coupler is incorporated in an amount of from 0.005 to 2 g/$m^2$.

11. A silver halide color photographic light-sensitive material as claimed in claim 1, wherein said compound releasing a development inhibitor or precursor thereof is a compound selected from the group consisting of compounds represented by formulae (XVI), (XVII) or (XVIII)

A—TIME—Z (XVI)

A—Z (XVII)

B—Z (XVIII)

wherein A represents a coupling component capable of reacting with an oxidized product of a color developing agent, and of releasing a group —TIME—Z upon reaction with the oxidized product of the color developing agent, B represents a redox portion releasing Z upon the oxidation-reduction reaction with the oxidized color developing agent followed by alkali hydrolysis, TIME represents a timing group, and Z represents a development inhibitor group.

12. A silver halide color photographic light-sensitive material as claimed in claim 1, wherein said compound releasing a development inhibitor or precursor thereof is incorporated in at least one of layers of a light-sensitive layer group and a non-light-sensitive layer group.

13. A silver halide color photographic light-sensitive material as claimed in claim 1, wherein said compound releasing a development inhibitor or precursor thereof is incorporated to the layer containing said coupler or adjacent layer thereto in an amount of from 0.001 to 1 mol per mol of the coupler.

14. A silver halide color photographic light-sensitive material as claimed in claim 1, wherein said compound releasing a development inhibitor or precursor thereof is incorporated to at least one layer other than the layer containing the coupler and the adjacent layer thereto in an amount of from 0.005 to 1 $g/m^2$.

15. A silver halide color photographic light-sensitive material as claimed in claim 1, wherein the wavelength is shifted in such an extent that the difference of the wavelength of the dye before the bond cleavage and after that is at least 20 nm.

16. A silver halide color photographic light-sensitive material as claimed in claim 11, wherein said compound releasing a development inhibitor or precursor thereof is a compound selected from the group consisting of compounds representing by formula (XVII) or (XVIII):

A—Z (XVII)

B—Z (XVIII)

wherein A represents a coupling component capable of reacting with an oxidized product of a color developing agent and of releasing a group Z upon reaction with the oxidized product of the color developing agent and B represents a redox portion releasing Z upon the oxidation-reduction reaction with the oxidized color developing agent followed by alkali hydrolysis, wherein Z represents a development inhibitor group.

* * * * *